US006533678B1

(12) United States Patent
Johnson

(10) Patent No.: US 6,533,678 B1
(45) Date of Patent: Mar. 18, 2003

(54) GOLF PUTTER WITH REMOVABLE AND REORIENTABLE STRIKING MEMBER

(76) Inventor: Gary O. Johnson, 1710 Grey Mill Dr., Upper St. Clair, PA (US) 15241

( * ) Notice: Subject to any disclaimer, the term of this patent is extended or adjusted under 35 U.S.C. 154(b) by 0 days.

(21) Appl. No.: 09/612,154

(22) Filed: Jul. 7, 2000

Related U.S. Application Data

(60) Provisional application No. 60/142,830, filed on Jul. 8, 1999.

(51) Int. Cl.[7] ..... A63B 53/08

(52) U.S. Cl. ..... 473/324; 473/325

(58) Field of Search ..... 473/288, 304, 473/325, 342, 350, 334, 338, 340, 341, 324, 349, 313, 314, 251, 238, 256, 335, 344, 332

(56) References Cited

U.S. PATENT DOCUMENTS

| | | | | |
|---|---|---|---|---|
| 2,222,534 A | * | 11/1940 | Harris | 473/248 |
| 2,530,446 A | * | 11/1950 | Beardsley | |
| 3,771,788 A | * | 11/1973 | Hurley et al. | 473/44 |
| 4,121,832 A | * | 10/1978 | Ebbing | |
| 4,422,638 A | | 12/1983 | Tucker | |
| 4,506,888 A | | 3/1985 | Nardozzi, Jr. | |
| 5,230,509 A | | 7/1993 | Chavez | |
| 5,332,214 A | | 7/1994 | Tucker, Sr. | |
| 5,407,196 A | | 4/1995 | Busnardo | |
| 5,415,399 A | * | 5/1995 | Kettelson | |
| 5,437,447 A | | 8/1995 | Rigutto | |
| 5,445,386 A | | 8/1995 | Marshall | |
| 5,531,439 A | * | 7/1996 | Azzarella | |
| 5,542,675 A | | 8/1996 | Micciche et al. | |
| 5,692,969 A | * | 12/1997 | Schooler | |
| 5,718,644 A | * | 2/1998 | Donofrio | |
| 5,863,257 A | | 1/1999 | Busnardo | |
| 5,921,871 A | | 7/1999 | Fisher | |
| 5,993,324 A | * | 11/1999 | Gammil | 473/251 |
| 6,179,727 B1 | * | 1/2001 | Giordano | |
| 6,238,303 B1 | * | 5/2001 | Fite | |
| 6,270,423 B1 | * | 8/2001 | Webb | |
| 6,328,662 B1 | * | 12/2001 | Huang | |
| 6,447,403 B1 | * | 9/2002 | Schmidt | 473/251 |

OTHER PUBLICATIONS

Farricker, Peter, "Quiet Please, 11 Sounds of Silence", *Golf Digest*, Jan. 1997, pp. 136–139.
Chwasky, Mike, "Changingface" *Golf Equipment Buyer's Guide*, 1998, pp. 6–8.
"Putters", *Golf Equipment Buyer's Guide*, 1998 pp. 72–74, 76–82, 84 and 87.

* cited by examiner

*Primary Examiner*—Paul T. Sewell
*Assistant Examiner*—Nini F. Legesse
(74) *Attorney, Agent, or Firm*—Webb Ziesenheim Logsdon Orkin & Hanson, P.C.

(57) ABSTRACT

Disclosed is a golf putter that has an interchangeable striking face, while maintaining the same head, shaft and grip. The various striking faces are made of different materials such that the golfer can change the rebound characteristics and resulting distance the golf ball travels from the putter face, while maintaining the exact same golf swing, by selecting an appropriate striking face as dictated by the current conditions of the putting surface.

6 Claims, 26 Drawing Sheets

GOLF PUTTER WITH REMOVABLE AND REORIENTABLE STRIKING MEMBER

CROSS REFERENCE TO RELATED APPLICATION

This application claims the benefit of U.S. Provisional Patent Application Serial No. 60/142,830 filed Jul. 8, 1999 entitled "Golf Putter With Set of Interchangeable Faces".

BACKGROUND OF THE INVENTION

1. Field of the Invention

This invention relates to golf clubs and, more particularly, to golf putters.

2. Description of Prior Art

According to John Elliot, a Golf Digest Schools instructor, "The cover of the ball in the last 20 years has gotten harder." See GOLF DIGEST, January 1997, "11 Sounds of Silence", page 136. Because the golf ball cover material has become harder, there is a marketing trend now for putters to be made out of different materials such as brass, aluminum, copper, stainless steel, nickel, titanium, or composites. It is also known for putters to have an insert material made of plastic or rubber. See 1998 ANNUAL GOLF EQUIPMENT GUIDE, "Putters", page 08. A good example of this is the putter line from Odyssey Golf which has a patented material face insert. In fact Odyssey Golf released a new line of putters based on their Stronomic™ system whereby three identical putters have a "soft", "standard" or "firm" insert so that any golfer can select a putter that fits their putting tendencies. Taylor Made has developed a unique putter where the "toe" and "heel" are made from brass and the middle section or "sweet spot" is made from aluminum. The use of these different materials in manufacturing is an attempt to control the "rebound" and longer "dwell time" of the golf ball when it is struck by the putter "face". The combined result is to provide a better "feel" and "control" to the golfer.

It is well known to golf enthusiasts and golfing equipment manufacturers that increased dwell time improves accuracy by causing the golf ball to skid less and begin rolling sooner to the hole upon impact with the putter face. See 1998 ANNUAL GOLF EQUIPMENT GUIDE, "Putters", page 73. However, these designs fail to address the environmental changes that a golfer has to adjust to at the golf course on a daily basis. It is well known that depending on the weather, grass type and condition, and speed of the greens, a ball will roll on the greens inconsistently from day to day even on the same course. These conditions can also change between the mornings and afternoons in most parts of the country. For example, if the putting surface is fast due to the shortness or dryness of the grass, then a "softer" stroke by the golfer is needed. Conversely, if the putting surface is slow due to longer grass or is wet due to rain, a "firmer" stroke is required by the golfer. Ideally, the golfer should change putters to match the conditions of the greens instead of changing his or her putting stroke and attempting to hit the ball firmer or softer for the same given distance. This would involve owning two or three putters made from different materials, since different materials have distinct feel and rebound qualities as described above, and selecting the appropriate putter for a particular round of golf.

SUMMARY OF THE INVENTION

To overcome the problems with the prior art, I have developed a golf putter that has an interchangeable striking face, while maintaining the same head, shaft and grip. The various striking faces are made of different materials such that the golfer can change the rebound characteristics and resulting distance the golf ball travels from the putter face, while maintaining the exact same golf swing, by selecting an appropriate striking face as dictated by the current conditions of the putting surface.

DESCRIPTION OF THE PREFERRED EMBODIMENTS

Figure 1:
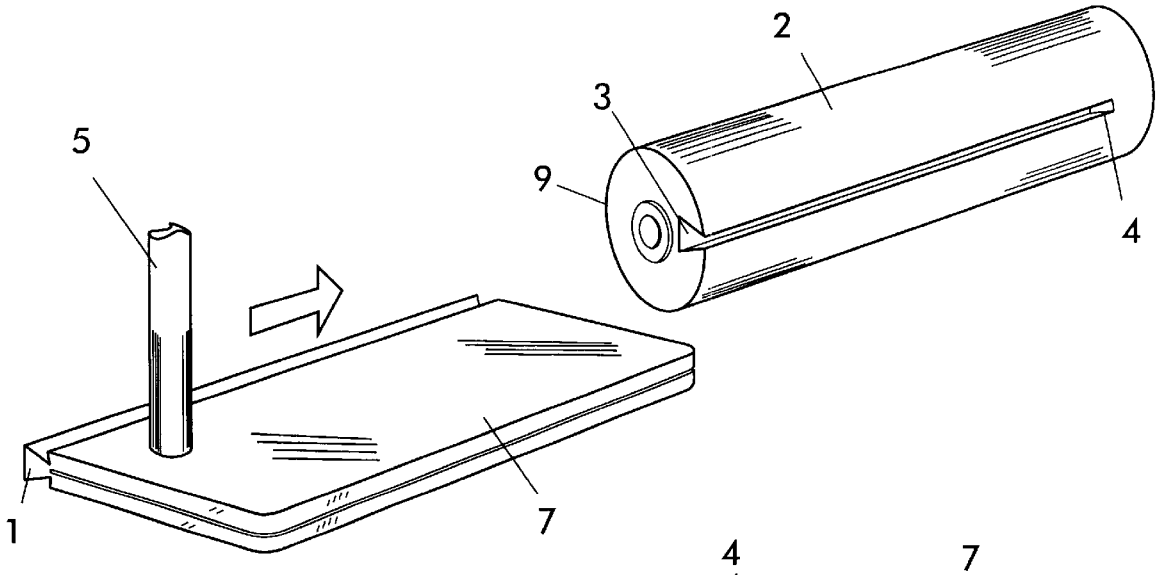
FIG. 1 is a disassembled perspective view of a first embodiment of a putter in accordance with the present invention.
Figure 3:
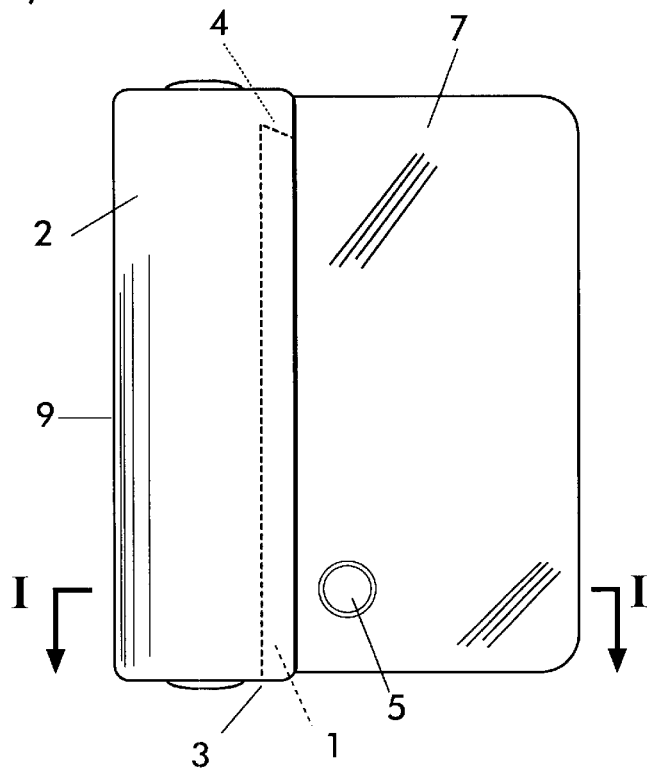
FIG. 3 is an assembled top view of the putter shown in FIG. 1.

My invention addresses the need for a new and improved golf putter with a set of interchangeable faces or striking surfaces made from different materials that a golfer can change quickly and easily depending on the prevailing conditions at the golf course. The golfer therefore can maintain a consistent putting stroke and mental attitude when striking the ball on a slow or fast green by changing the face as required before starting the round.

Therefore, in accordance with the present invention, there is provided a golf putter having interchangeable faces or striking surfaces and a unique head or fixed body that preferably includes a standard double-bend putter shaft and standard putter grip.

Another object of the present invention is to provide for a set of faces made from different materials such as aluminum, copper, Delrin™ or polymeric material; or a single composite cylinder or composite rectangle made out of the same different materials. The object of the use of these materials is to control the rebound of the golf ball off of the putter face at impact. The added benefit of these said face materials is increased "dwell" time, that is, how long the golf ball stays in contact with the putter.

Another object of the present invention is to provide the sole of the striking member with a flat arch that more resembles a standard blade putter and allows the golfer more leeway in standing closer or farther from the ball. Also, the top of the striking member can be flat and include a perpendicular.slot machined into the material to act as an alignment guide which is more like a conventional putter.

Further in accordance with the present invention there is a threaded pin that inserts through one guideway and locks the composite cylinder or rectangle together with the fixed body when assembled.

Further in accordance with the present invention there is provision for the putter to be "face balanced", that is, when the putter is balanced on the index finger the face should be parallel to the ground. It is known to golf enthusiasts and golfing equipment manufacturers that this helps to square the putter face at impact.

A further object of the present invention is to provide for right and left hand use. By incorporating a double-bend putter shaft design and a 90 degree bore hole in the putter head, left hand usage is accomplished by moving the 90 degree bore hole to the opposite end of the fixed body.

Another object of the present invention is to provide a unique design based on form and function and utilizing sound industrial design principles providing inherent features which will aid the golfer in mastering the art of putting.

For example, visual clues can be provided to assist the golfer in lining up for a putt and aiding the golfer in keeping the putter on line during the putting swing.

A further object of the present invention is the ability to replace the putter face or composite face with a new one should the original said face become damaged or worn without replacing the entire putter.

FIGS. 1–10 show a first embodiment of a putter in accordance with the present invention. The putter includes a fixed body 7 having a drilled shaft hole 6 therein and a standard double-bend shaft 5 attached to the fixed body 7. The shaft 5 includes an upper end portion having a standard grip 12. The fixed body 7 is attached to the shaft 5 via the shaft hole 6. The location of the shaft hole 6 determines right or left hand usage depending on the toe or heel placement at time of manufacture. A striking member 2 having a striking surface 9 is attached to a leading edge of the fixed body 7.

The fixed body 7 is a substantially flat, rectangular member and may be manufactured from any suitable material, such as stainless steel, brass, aluminum or composite material. The striking member 2 shown in FIGS. 1–10 has a cylindrical shape. The outermost surface 9, away from the fixed body 7, functions as the striking surface or face of the putter. An important feature is the centered trailing edge of the fixed body 7 in relation to the striking member 2 when assembled as shown in FIG. 2. By the incorporation of the double-bend shaft 5, and the hole location 6 with respect to the trailing edge of the fixed body 7, a unique dynamic balance point of the assembled putter has been achieved. Specifically, during the backswing and forward stroke follow through, the head and shaft dynamically become in balance to the "pendulum" effect that the golfer is trying to achieve. This feature can easily be demonstrated by resting the bottom of the putter on the ground. The top of the shaft will lean away from the striking member. The inherent net effect of this is to coax the golfer into taking a more positive grip and stance, resulting in a more even backswing and forward stroke follow through.

A dovetail guide 1 machined into the leading edge of the fixed body 7 interlocks with a dovetail slot 3 machined into interchangeable striking member 2. The dovetail slot 3 extends about 80% the length of the striking member 2 and includes an entry port at one end (commonly known as the heel) and a fixed stop 4 at the other end (commonly known as the toe). The machine tolerances between guide 1 and slot 3 shall be such that an extremely tight friction fit shall be the result. This permits the entire striking member 2, made of a specific material such as brass, aluminum or elastomeric material such as Delrin™, to be selected from a set by the golfer and quickly and easily changed the striking member 2 to one of another material while maintaining the same fixed body 7, shaft 5 and grip 12. The sole intent is to affect the rebound and resulting distance the golf ball travels from the putter face while the golfer maintains the exact same golfswing in relation to the conditions of the putting surface.

Figure 2:
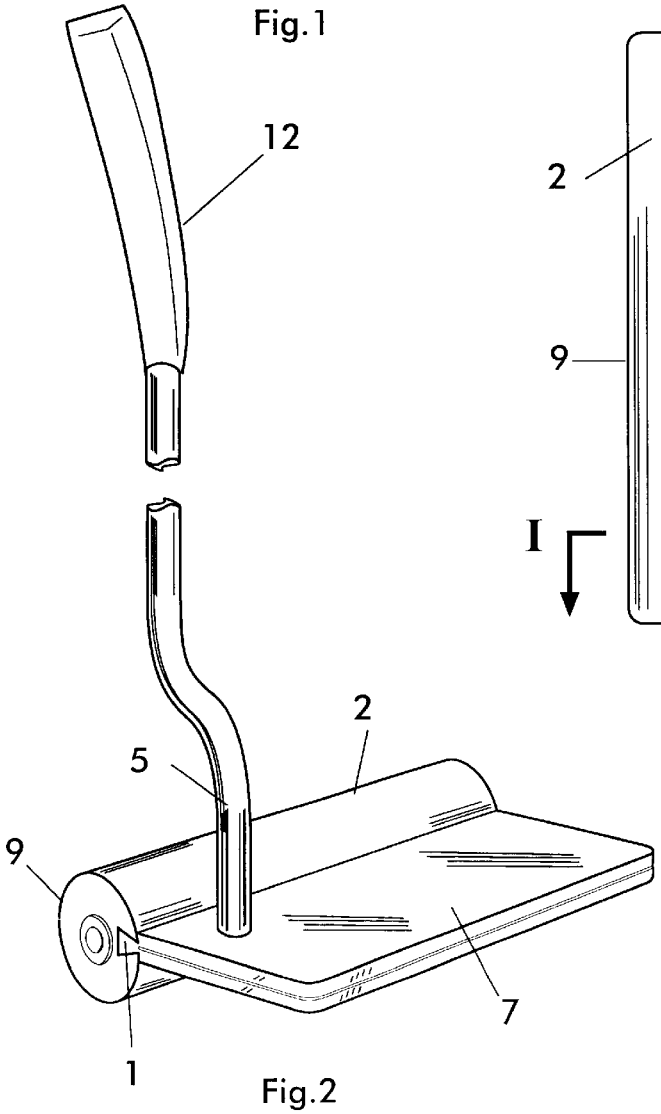
FIG. 2 is an assembled perspective view of the putter shown in FIG. 1.
Figure 4:
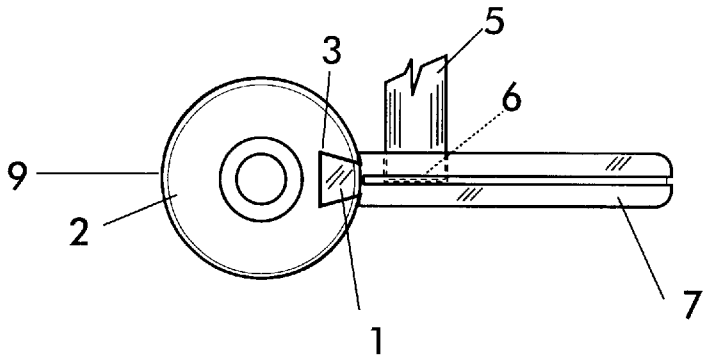
FIG. 4 is an assembled side view of the putter shown in FIG. 1.
Figure 5:
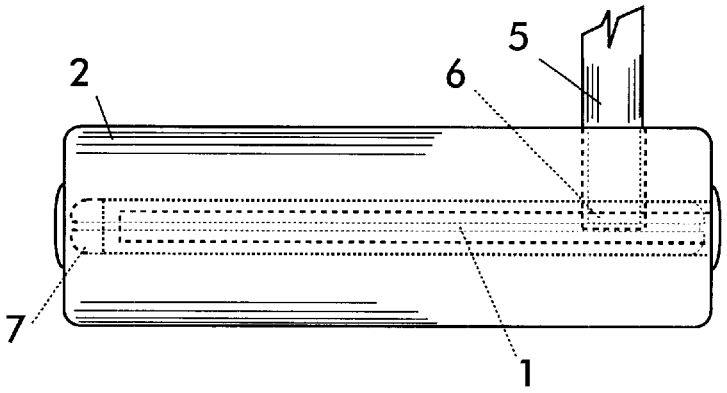
FIG. 5 is an assembled front view of the putter shown in FIG. 1.
Figure 6:
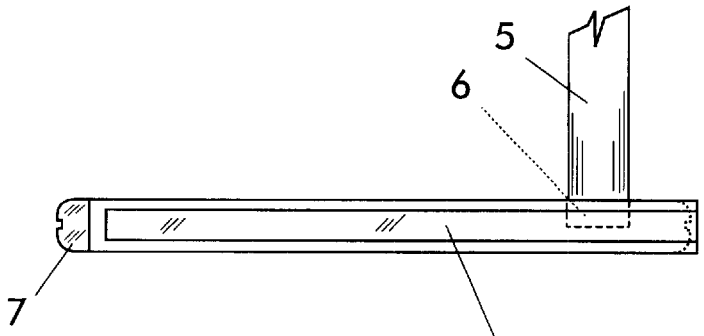
FIG. 6 is a disassembled front view of the putter shown in FIG. 1.
Figure 7:
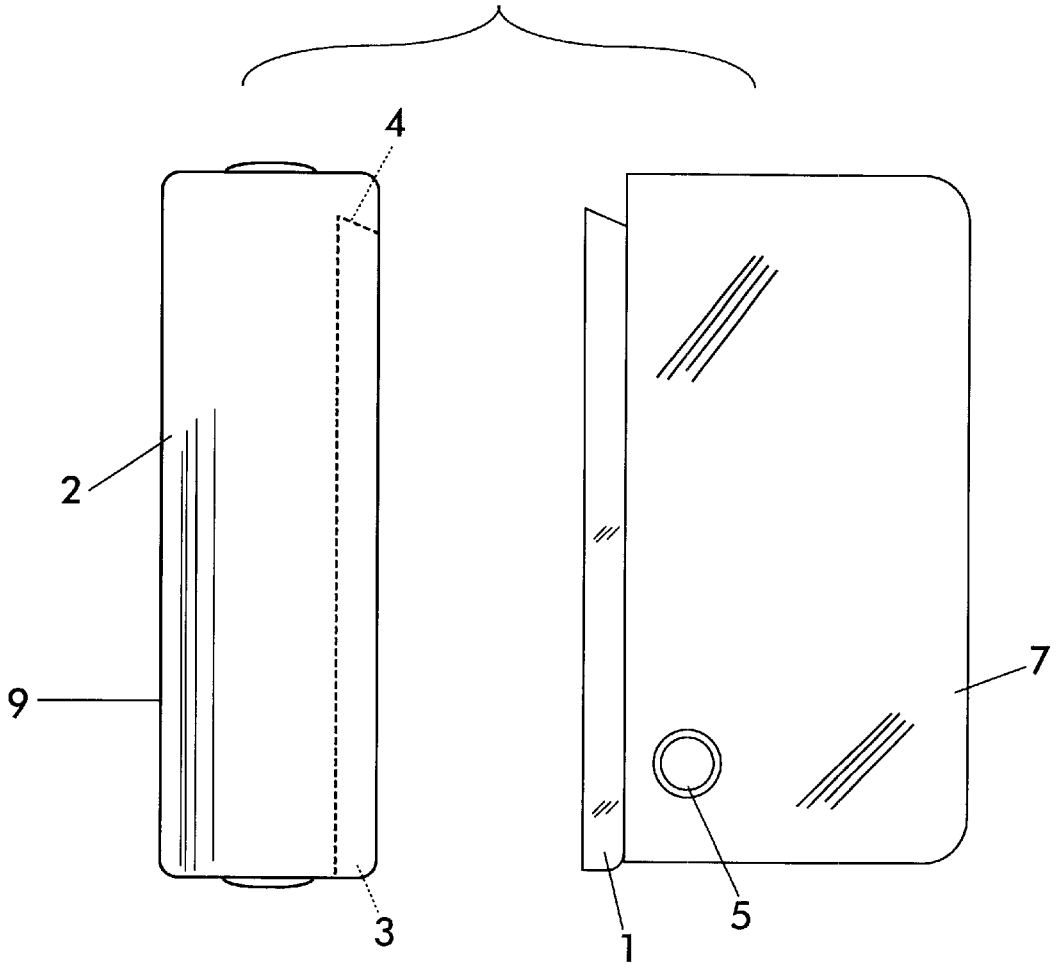
FIG. 7 is a disassembled top view of the putter shown in FIG. 1.
Figure 8:
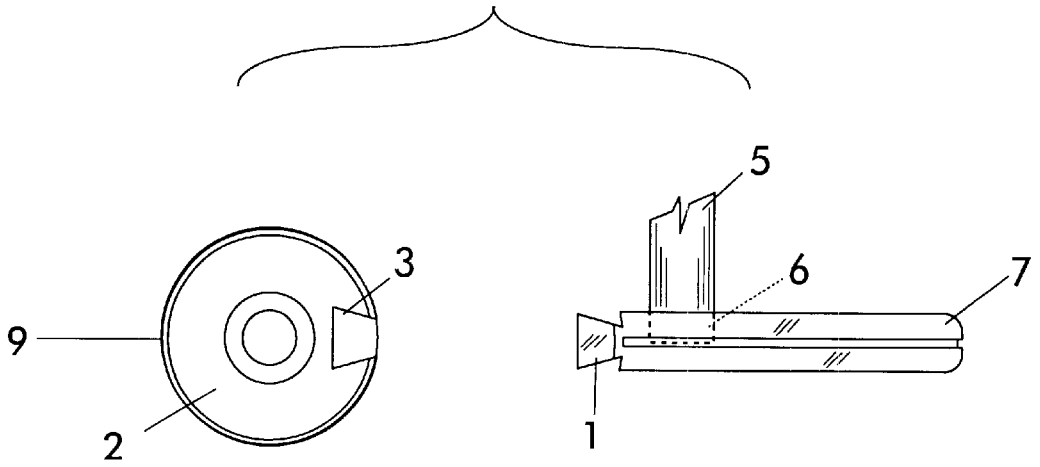
FIG. 8 is a disassembled side view of the putter shown in FIG. 1.
Figure 9:
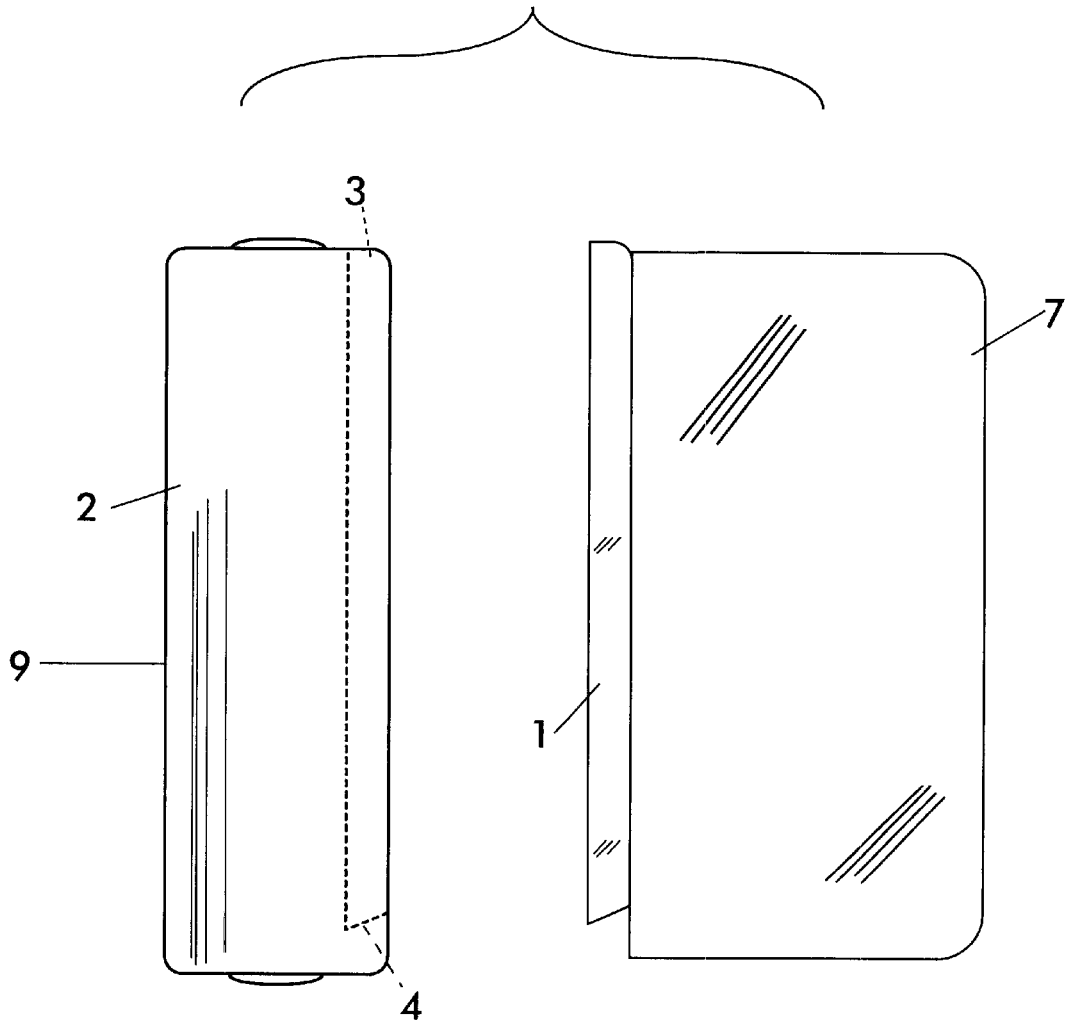
FIG. 9 is a disassembled bottom view of the putter shown in FIG. 1.
Figure 10:
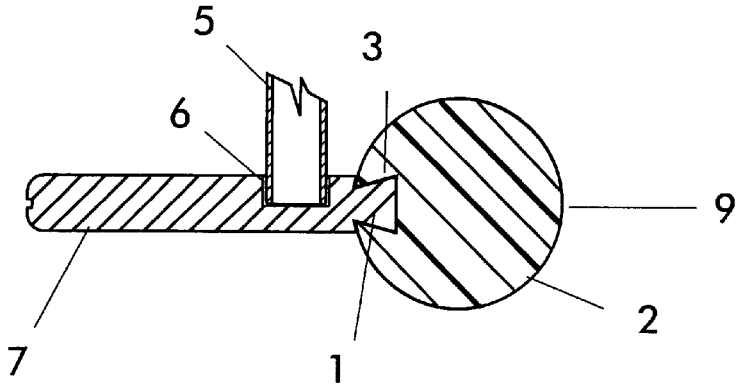
FIG. 10 is a section taken along lines I—I in FIG. 3.

To assemble the selected striking member 2 to the fixed body 7, as illustrated in FIG. 1, the golfer grasps the fixed body 7 in one hand and the striking member 2 in the other hand and positions dovetail guide 1 into dovetail slot 3 and slides the two elements (2 and 7) together until dovetail guide 1 seats with fixed stop 4. Accordingly, to remove striking member 2 from fixed body 7, simply reverse the procedure.

FIGS. 11–19 show a second embodiment of a putter in accordance with the present invention. The fixed body 7, shaft 5 and dovetail guide 1 are the same as in the first embodiment discussed above.

A striking member 20 has a rounded front surface 11 functioning as a striking surface and a rounded rear surface while the top of the striking member 20 is flat and has a perpendicular slot 80 machined into the top of the material to act as an alignment guide during the putting stroke. The sole of the striking member 20 has a flat arch that more resembles a standard blade putter and allows the golfer more leeway in standing closer or farther from the ball. This design can be based on standard loft-lie club manufacturing tables.

Dovetail guide 1 machined into the leading edge of the fixed body 7 interlocks with a dovetail slot 30 machined into the rear surface of the striking member 20. The dovetail slot 30 extends the length of the striking member 20 and includes an entry port 40 at either end. The machine tolerances between guide 1 and slot 30 shall be such that an extremely tight friction fit shall be the result. This permits the entire striking member 20 of a specific material such as brass, aluminum or elastomeric material such as Delrin™ to be selected from a set by the golfer and quickly and easily changed while maintaining the same fixed body 7, shaft 5 and grip 12. The net result is the same as the first embodiment.

Figure 11:
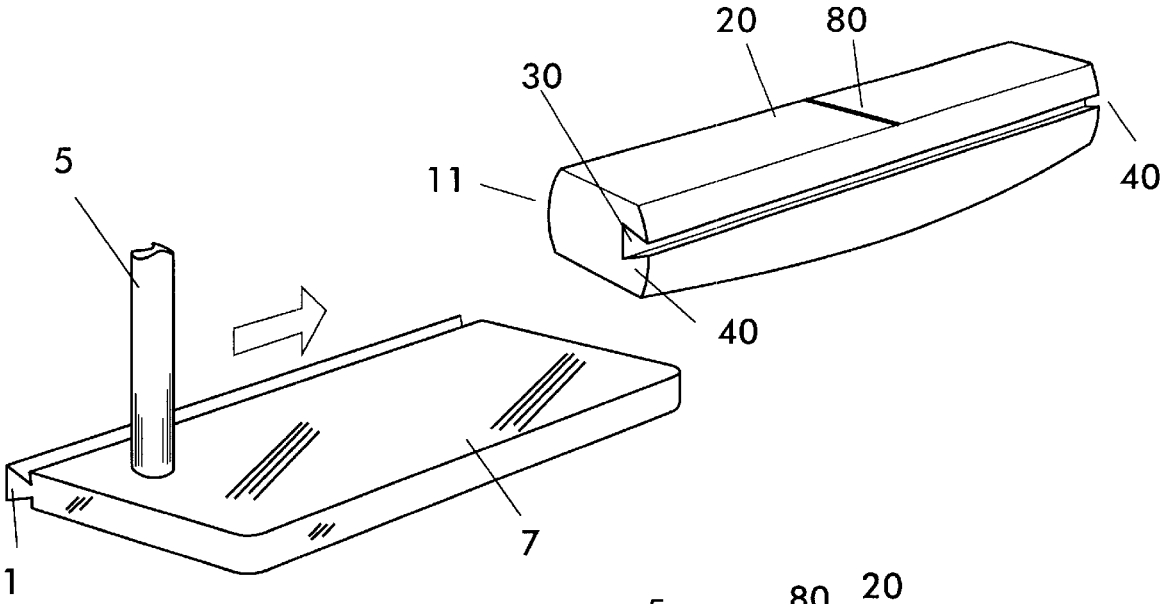
FIG. 11 is a disassembled perspective view of a second embodiment of a putter in accordance with the present invention.
Figure 12:
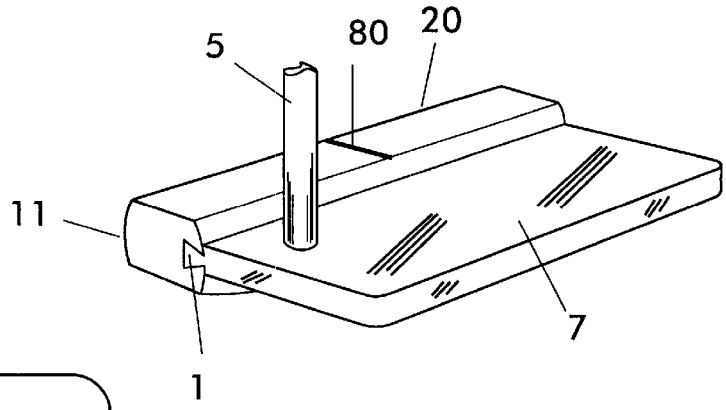
FIG. 12 is an assembled perspective view of the putter shown in FIG. 11.
Figure 13:
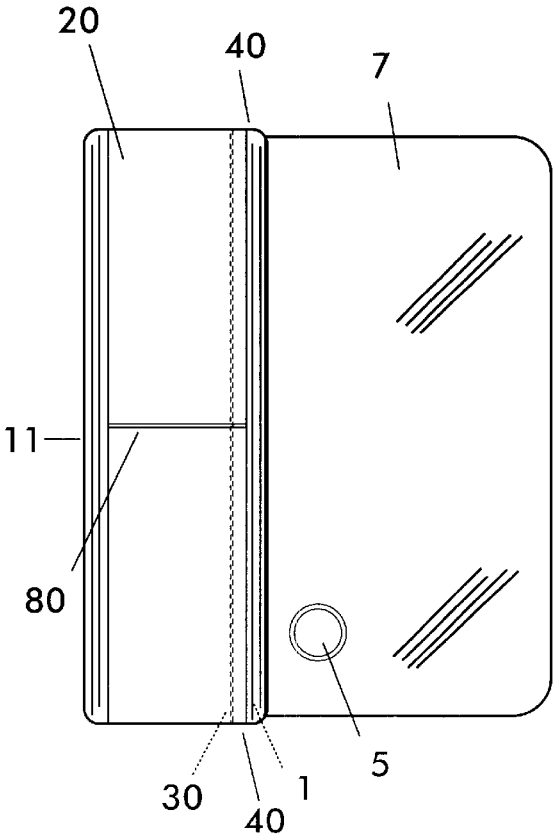
FIG. 13 is an assembled top view of the putter shown in FIG. 11.
Figure 14:
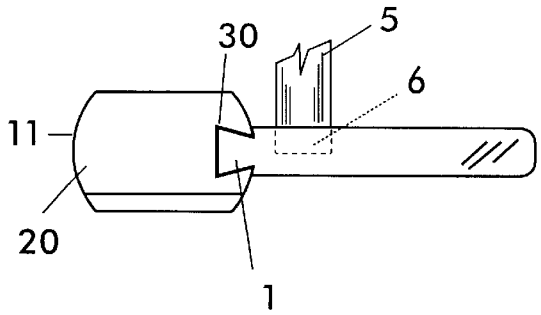
FIG. 14 is an assembled side view of the putter shown in FIG. 11.
Figure 15:
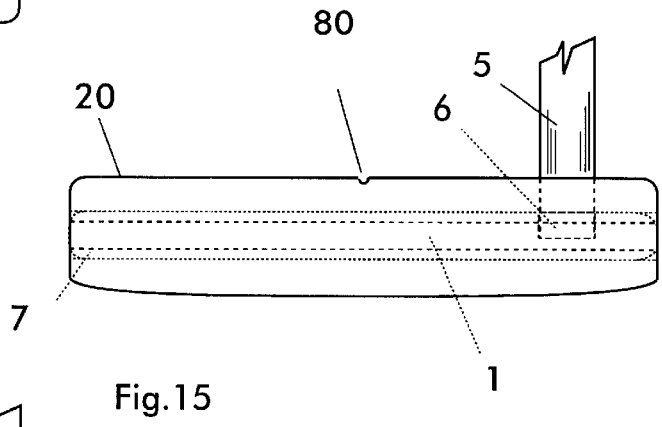
FIG. 15 is an assembled front view of the putter shown in FIG. 11.
Figure 16:
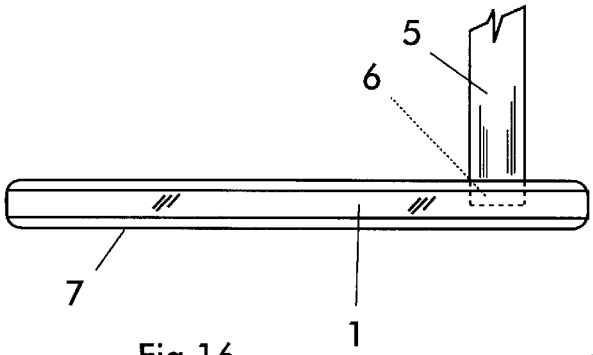
FIG. 16 is a disassembled front view of the putter shown in FIG. 11.
Figure 17:
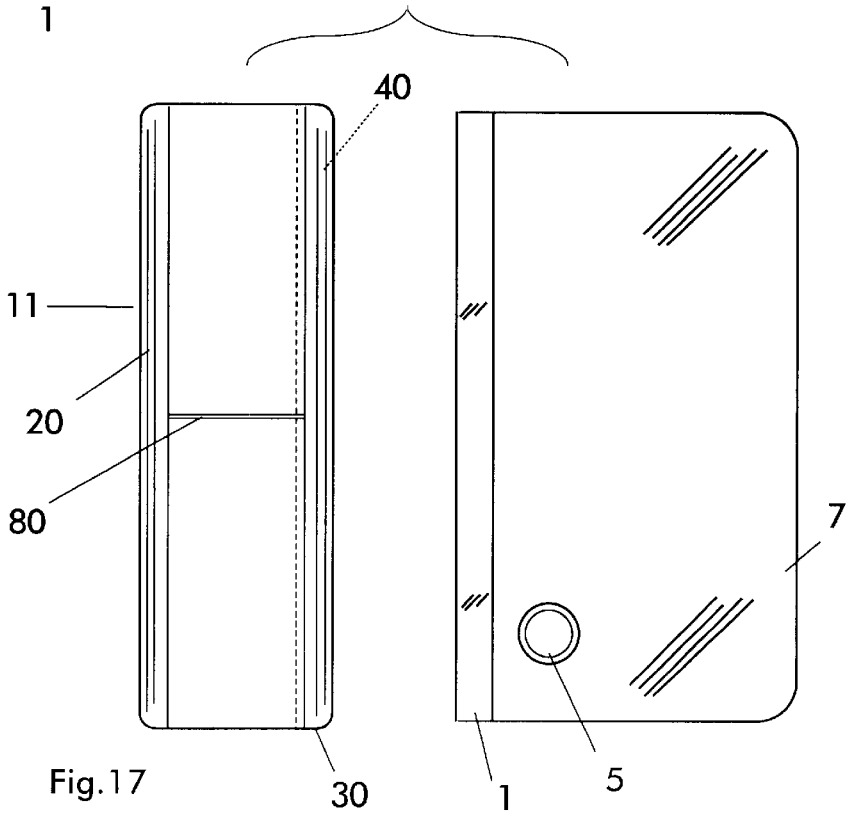
FIG. 17 is a disassembled top view of the putter shown in FIG. 11.
Figure 18:
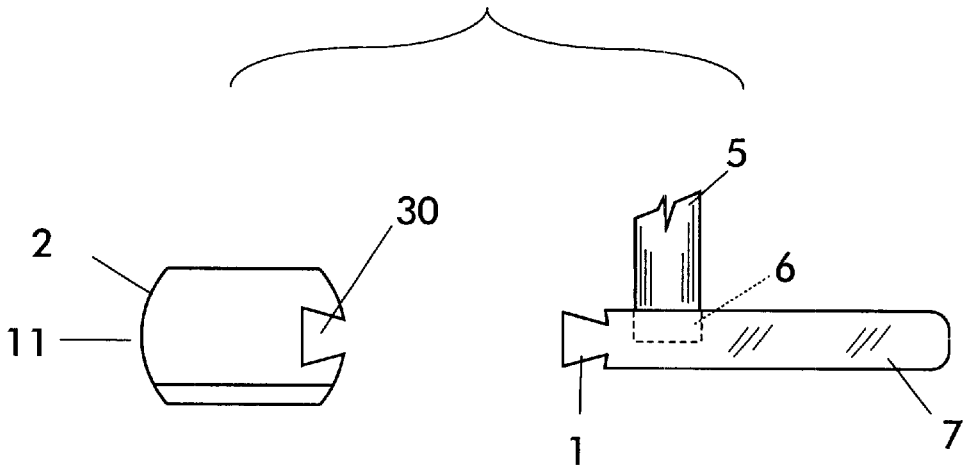
FIG. 18 is a disassembled side view of the putter shown in FIG. 11.
Figure 19:
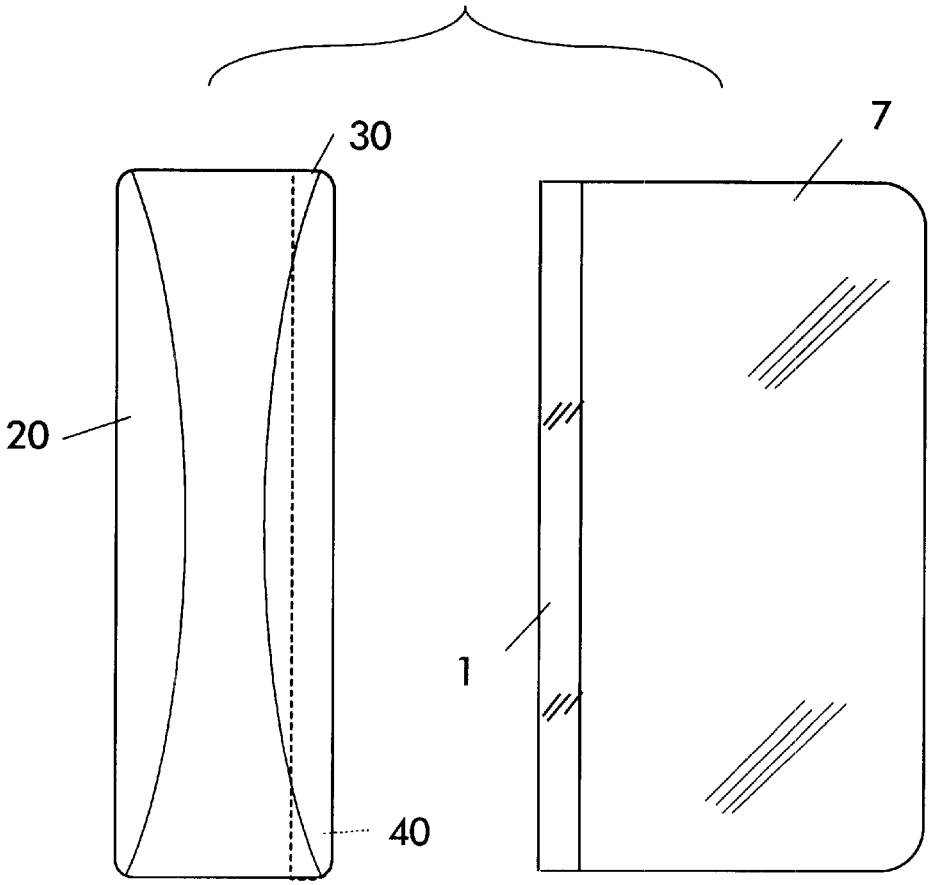
FIG. 19 is a disassembled bottom view of the putter shown in FIG. 11.
Figure 20:
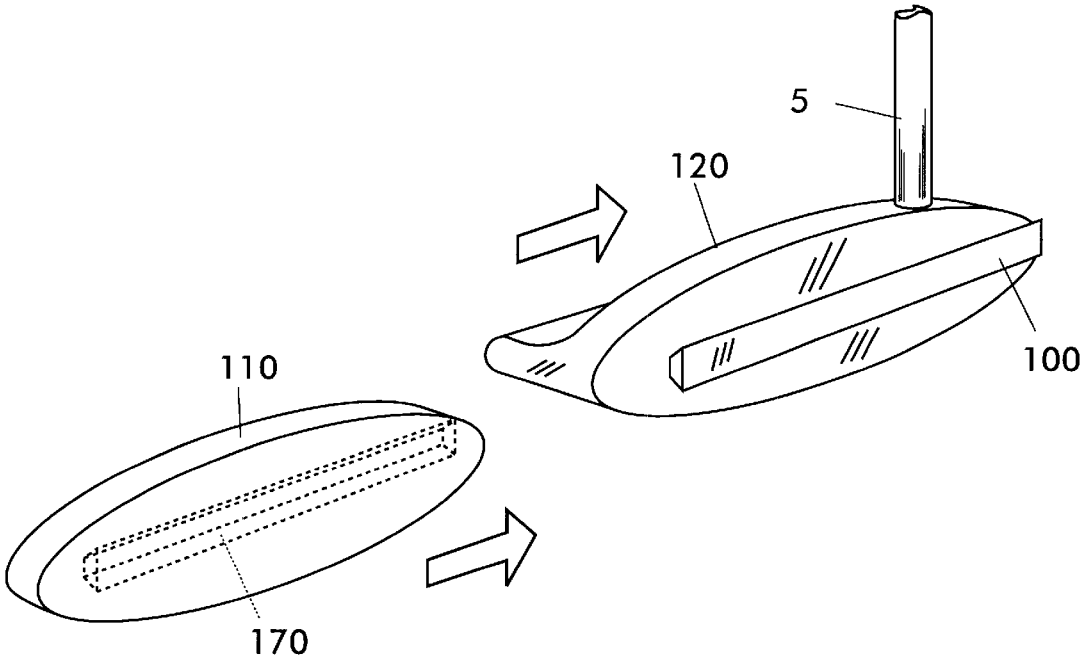
FIG. 20 illustrates a disassembled perspective view of a third embodiment of a putter in accordance with the present invention.
Figure 21:
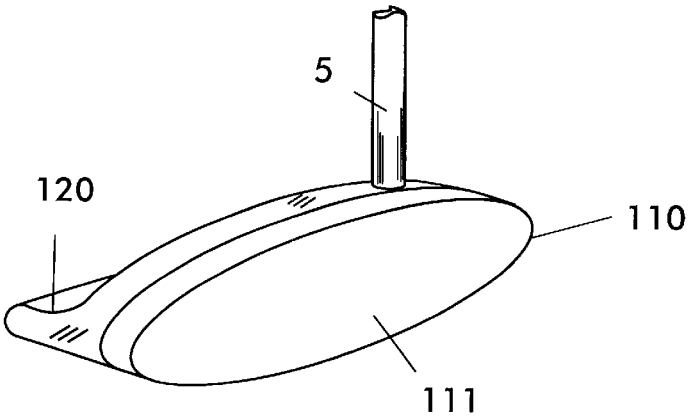
FIG. 21 is an assembled perspective view of the putter shown in FIG. 20.
Figure 22:
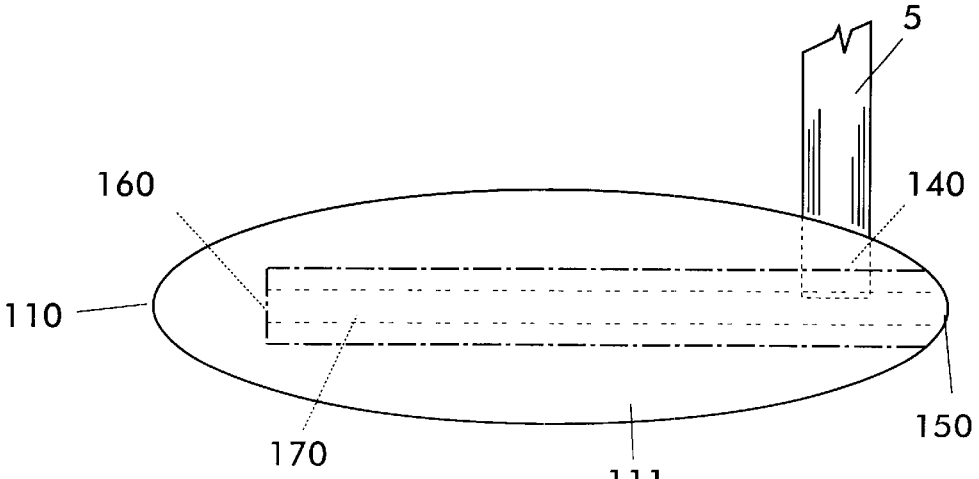
FIG. 22 is an assembled front view of the putter shown in FIG. 20.
Figure 23:
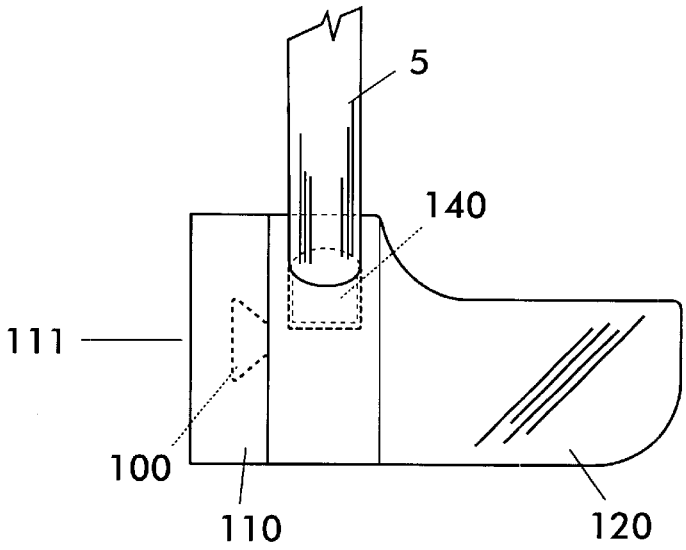
FIG. 23 is an assembled side view of the putter shown in FIG. 20.
Figure 24:
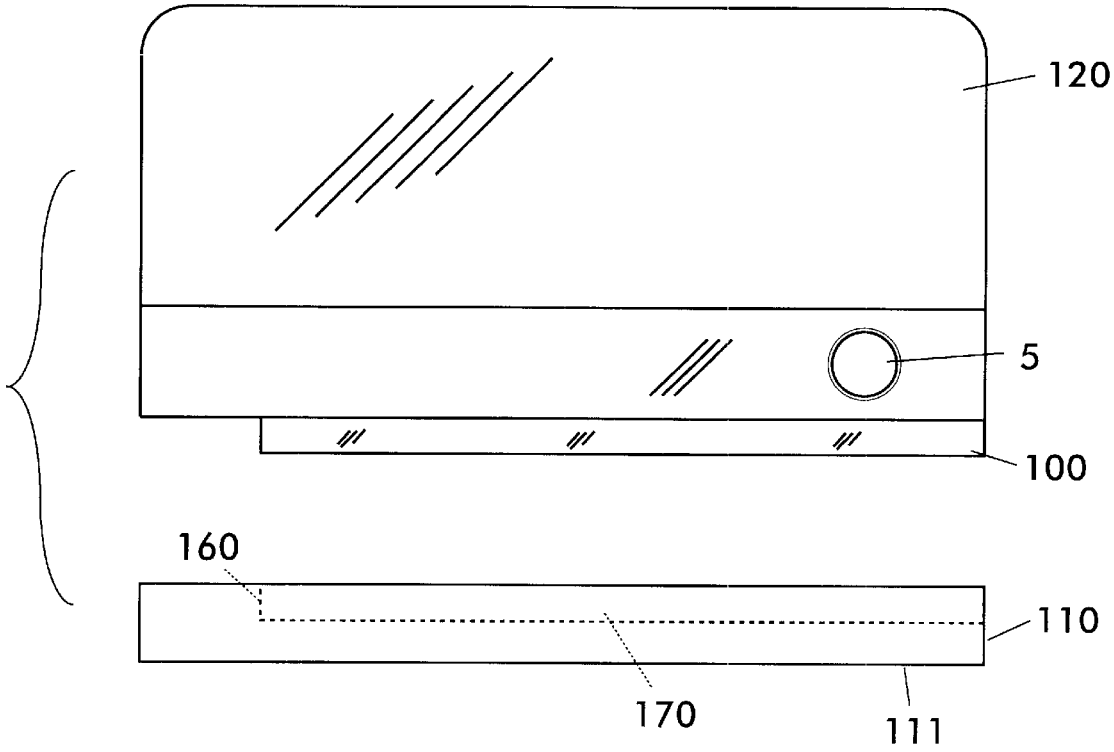
FIG. 24 is a disassembled top view of the putter shown in FIG. 20.
Figure 25:
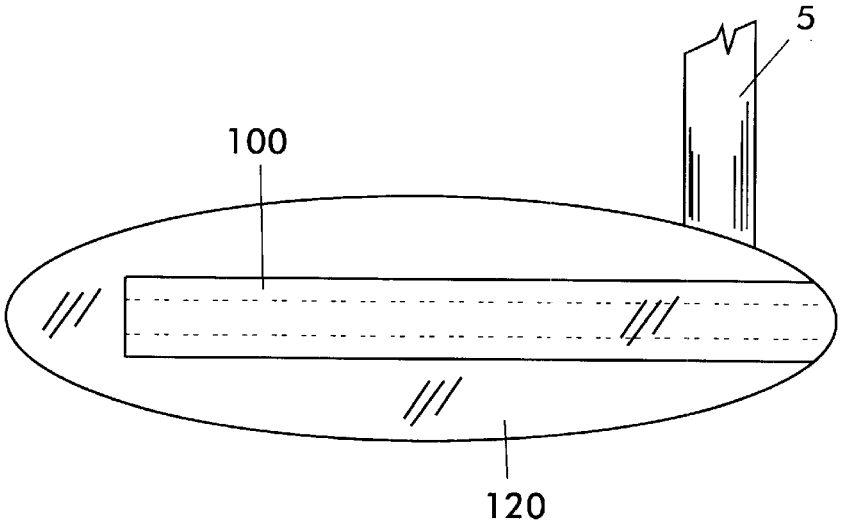
FIG. 25 is a disassembled front view of the putter shown in FIG. 20.
Figure 26:
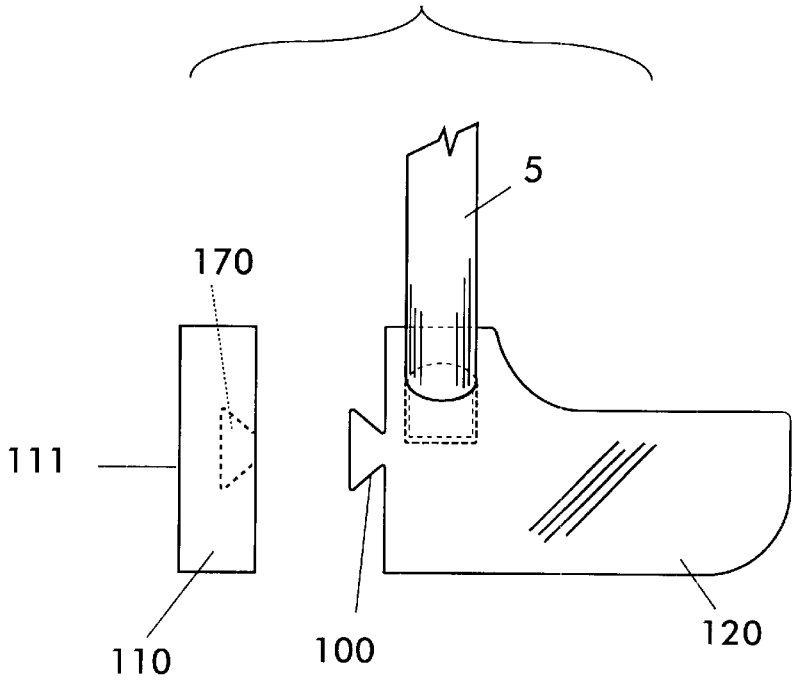
FIG. 26 is a disassembled side view of the putter shown in FIG. 20.
Figure 27:
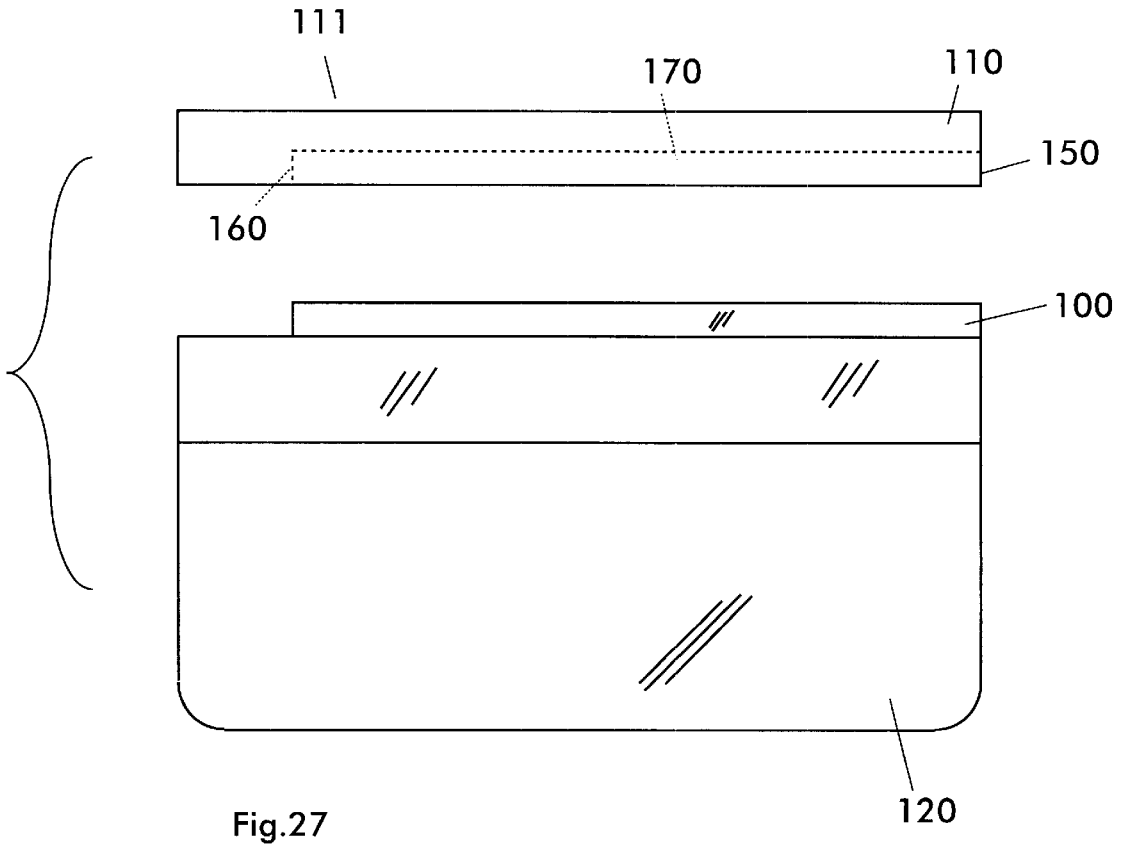
FIG. 27 is a disassembled bottom view of the putter shown in FIG. 20.
Figure 28:
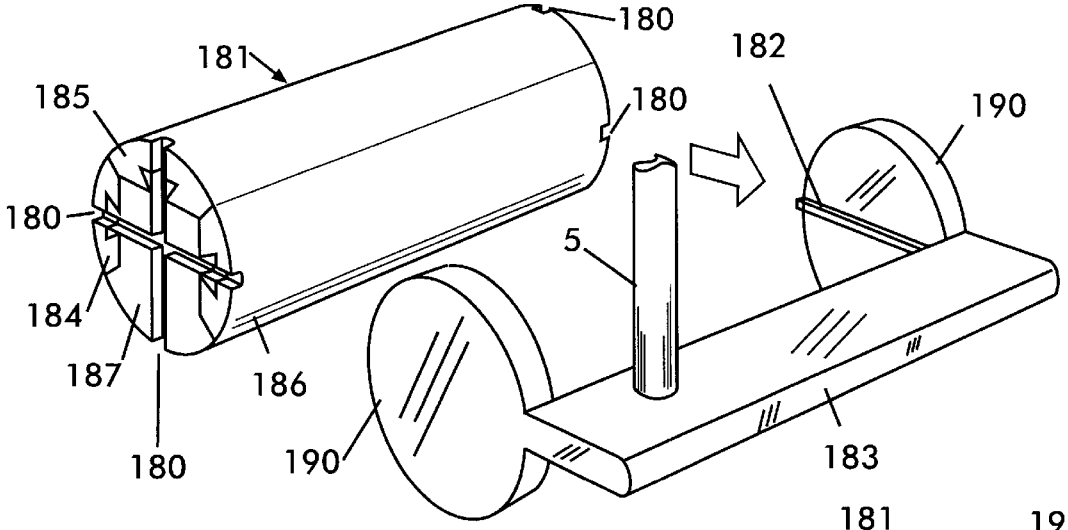
FIG. 28 is a disassembled perspective view of a fourth embodiment of a putter in accordance with the present invention.
Figure 29:
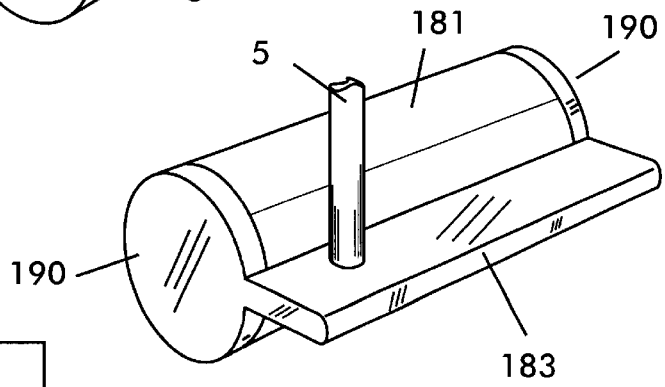
FIG. 29 is an assembled perspective view of the putter shown in FIG. 28.
Figure 30:
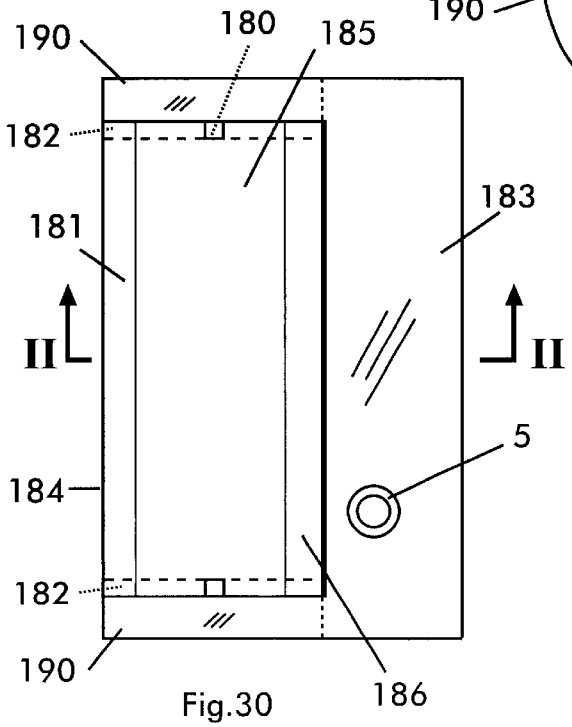
FIG. 30 is an assembled top view of the of the putter shown in FIG. 28.
Figure 31:
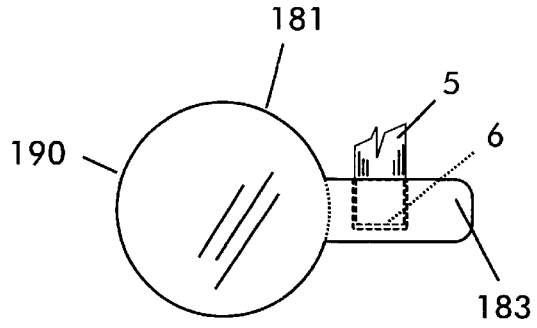
FIG. 31 is an assembled side view of the putter shown in FIG. 28.
Figure 32:
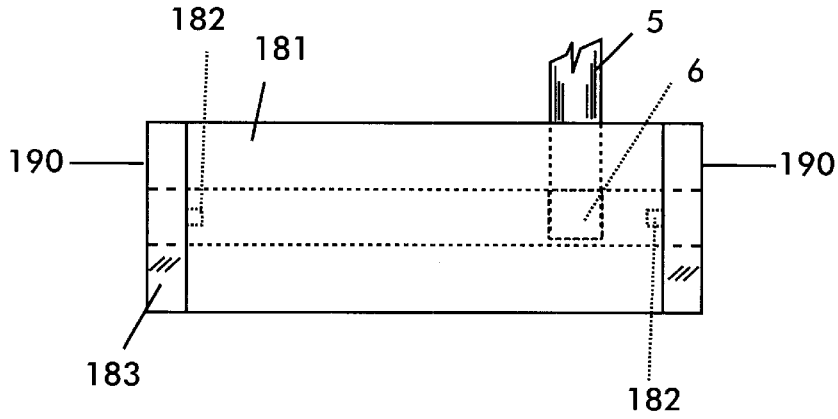
FIG. 32 is an assembled front view of the putter shown in FIG. 28.
Figure 33:
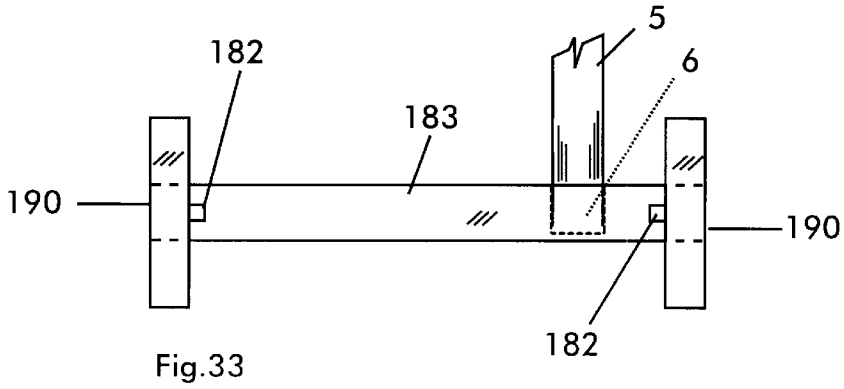
FIG. 33 is a disassembled front view of the putter shown in FIG. 28.
Figure 34:
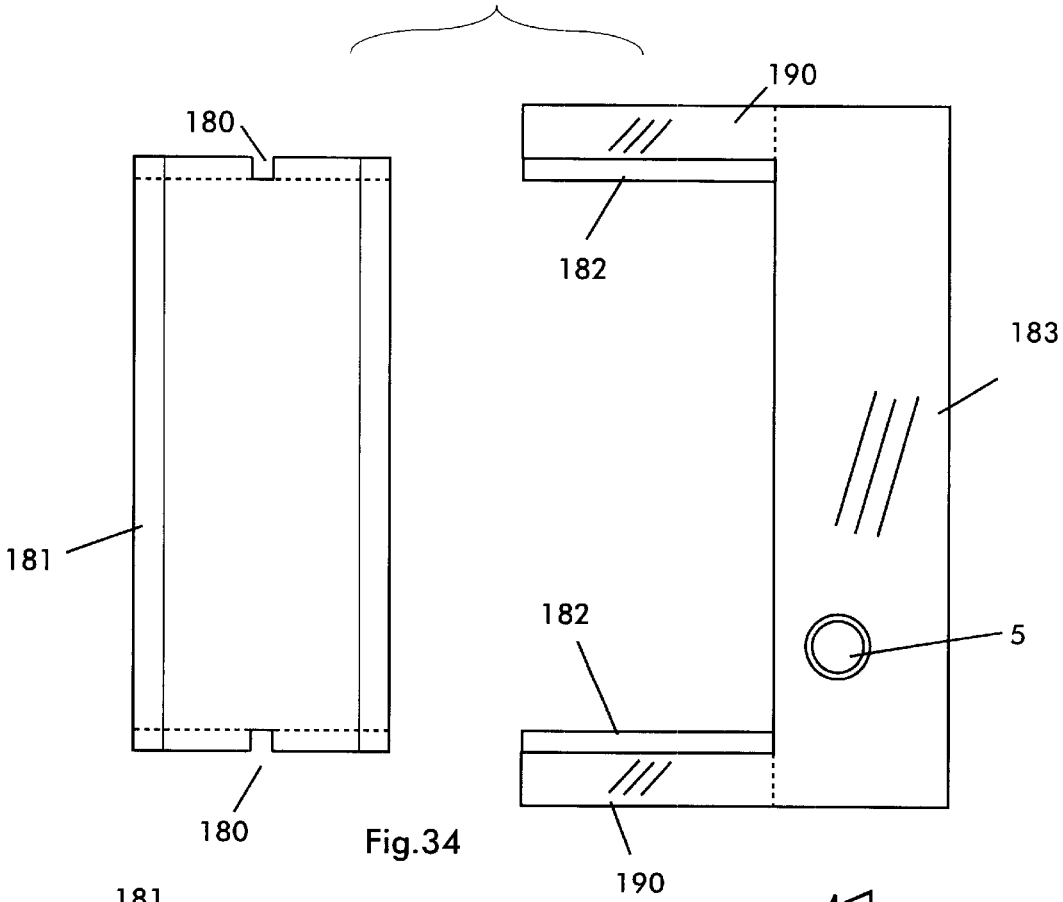
FIG. 34 is a disassembled top view of the putter shown in FIG. 28.

To assemble the striking member 20 to the fixed body 7 as illustrated in FIG. 11, the golfer grasps the fixed body 7 in one hand and the striking member 20 in the other hand and positions dovetail guide 1 into dovetail slot 30 continuing to slide together until both fixed body 7 and striking member 20 are even at each end. Accordingly, to remove striking member 20 from fixed body 7, simply reverse the procedure.

FIGS. 20–27 show a third embodiment of a putter in accordance with the present invention. The putter includes a fixed body 120 attached to the standard double-bend shaft 5. A striking member 110 having a striking surface 111 on the front thereof is attached to a leading edge of the fixed body 120. The fixed body 120 has a dovetail guide 100 protruding from a mating surface face at the leading edge and extending from the heel approximately 80% toward the toe. The striking member 110 has a corresponding dovetail slot 170 on the rear thereof. The striking member 110 and fixed body 120 are made of materials similar to those described above with the first and second embodiments, and the assembly and disassembly of the components are the same. Reference numeral 160 illustrates a fixed stop and reference numeral 150 illustrates an entry port machined into the striking member 110. Also, left or right hand usage would be determined by heel or toe placement of a shaft hole 140 at time of manufacture. The assembled putter would also be face balanced. However, it should be pointed out that the overall design of this embodiment is based on a more conservative approach incorporating the best attributes of standard blade and mallet type putters.

The embodiments discussed above have required multiple and separate striking members for changing the material of the striking surfaces and changing the nature of the putter for varying playing conditions. The embodiment illustrated in FIGS. 28–36 is a putter which has a single striking member which can be removed from the putter, re-oriented in a different direction and provide a different striking material at the face of the putter when striking the ball. Multiple and separate striking members are not needed in this embodiment.

The putter shown in FIGS. 28–36 has a substantially flat, rectangular fixed body 183 having a shaft 5 attached thereto. The location of the drilled shaft hole 6 in the fixed body determines whether the putter is appropriate for right or left hand usage. The fixed body 183 includes a pair of attachment arms 190 extending outward from a leading edge of the fixed body 183 at opposite ends thereof and integral therewith. The arms are generally flat, circular members and are spaced apart from each other and define a recess therebetween which receives a cylindrically shaped striking member 181 therein. The facing surfaces of the arms 190 each carry a slot or guideway 182 extending outwardly therefrom and in the same plane as the fixed body 183 and generally perpendicular to the leading edge of the fixed body 183.

As per the first embodiment, the fixed body 183 and the arms 190 may be manufactured from any suitable material such as stainless steel, brass, aluminum or composite material. It should be noted at this point that the design of the fixed body 183 is such to maximize heel and toe weighting of the putter by the arms 190. This feature will help keep the putter on line during the putting swing, also reducing the possible twisting of the putter face at impact.

As per previous embodiments, another design feature is the centered trailing edge of the fixed body 183 in relation to the composite cylinder shape of the striking member 181 when the putter is assembled. By the incorporation of a double-bend shaft 5, and hole location 6 in regard to the trailing edge of the fixed body 183, a unique dynamic balance point of the assembled putter has been achieved as per the first embodiment.

The guideways 182 formed on the arms 190 and defining the recess of the fixed body 183 mate with machined slots 180 in the composite cylinder striking member 181. The machine tolerances between guideways 182 and slots 180 shall be such that an extremely tight friction shall be the result. This permits the striking member 181 to be disengaged from the fixed body 183 by the golfer and easily reassembled and re-oriented to a different material that will strike the ball. Simply stated, the golfer grasps the fixed body 183 with one hand and with the other grasps the striking member 181. The striking member 181 is then removed from the recess in the fixed body 183. A different striking member is chosen by the golfer by rotating the striking member 181 and the putter is reassembled by aligning guideways 182 and slots 180 and seating the striking member 181 into the recess of the fixed body 183.

Figure 35:
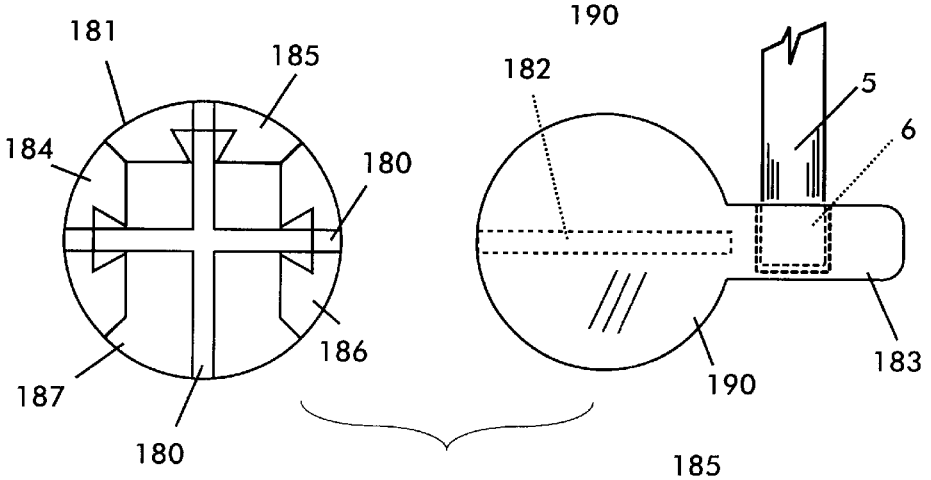
FIG. 35 is a disassembled side view of the putter shown in FIG. 28.
Figure 36:
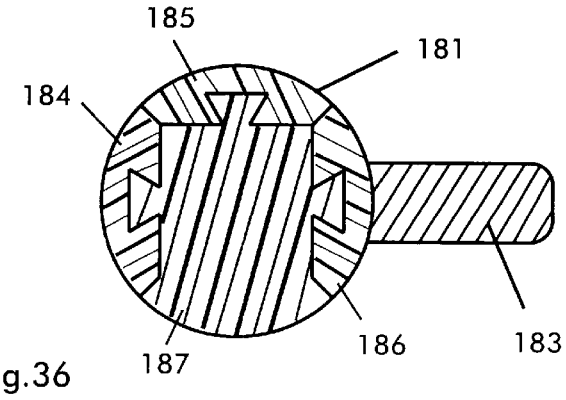
FIG. 36 is a section taken along lines II—II in FIG. 30.
Figure 37:
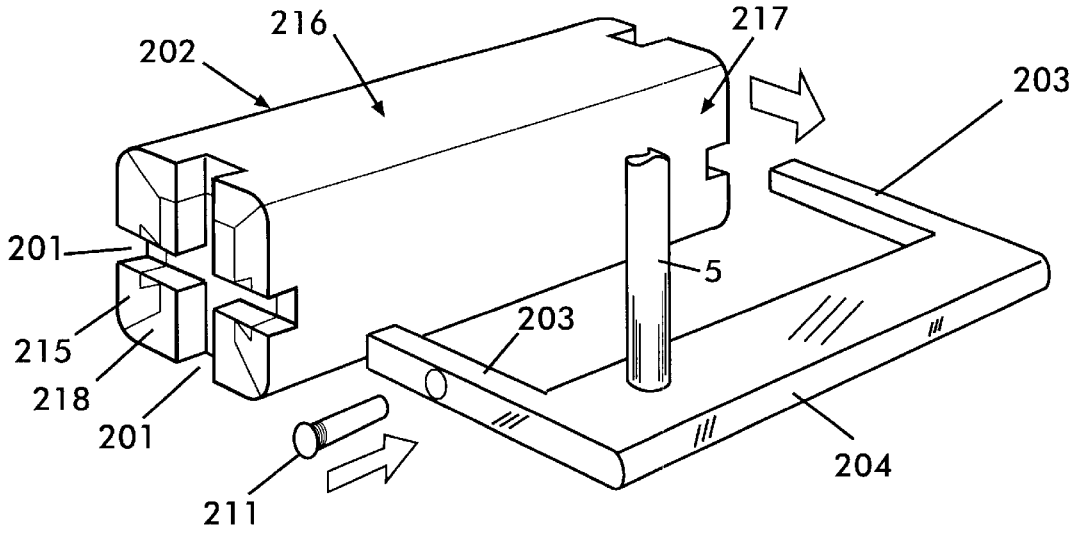
FIG. 37 is a disassembled perspective view of a fifth embodiment of a putter in accordance with the present invention.
Figure 38:
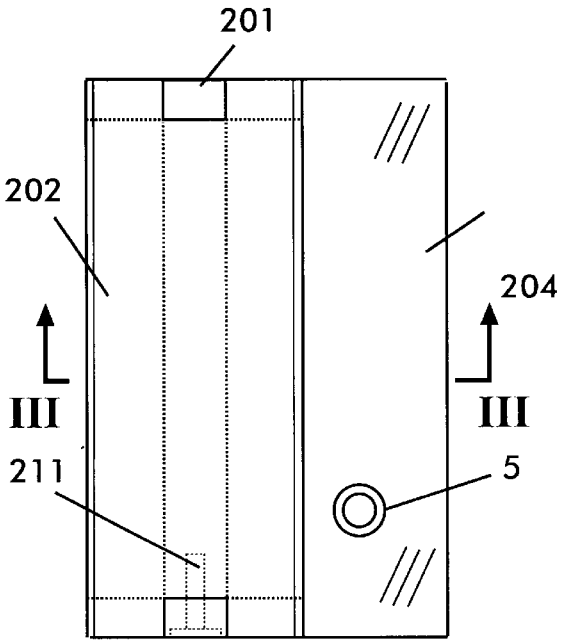
FIG. 38 is an assembled top view of the putter shown in FIG. 37.
Figure 39:
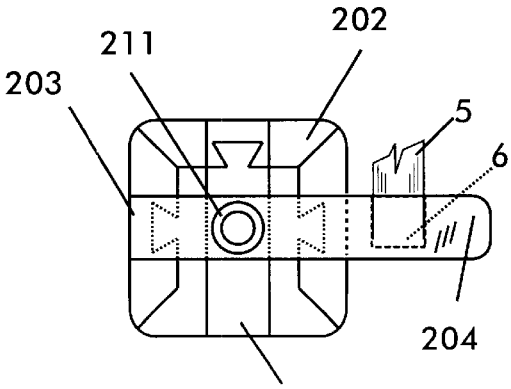
FIG. 39 is an assembled side view of the putter shown in FIG. 37.
Figure 40:
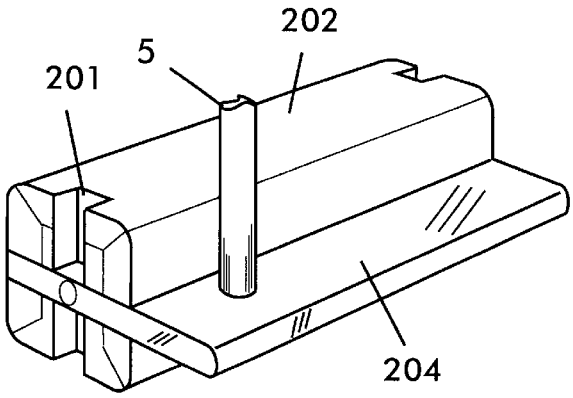
FIG. 40 is an assembled perspective view of the putter shown in FIG. 37.
Figure 41:
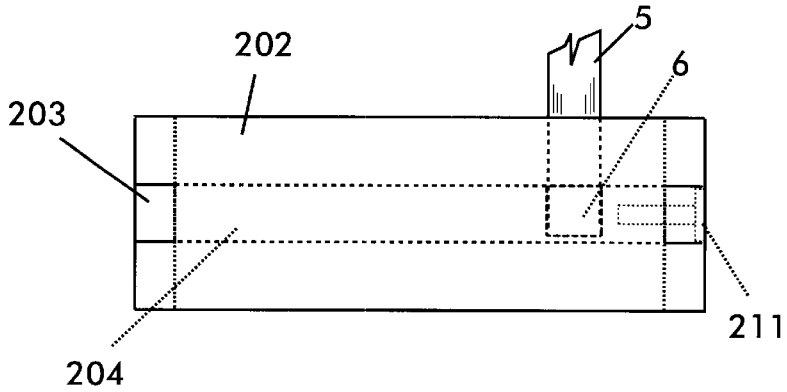
FIG. 41 is an assembled front view of the putter shown in FIG. 37.
Figure 42:
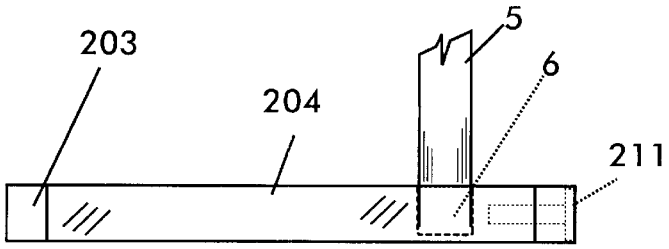
FIG. 42 is a disassembled front view of the putter shown in FIG. 37.
Figure 43:
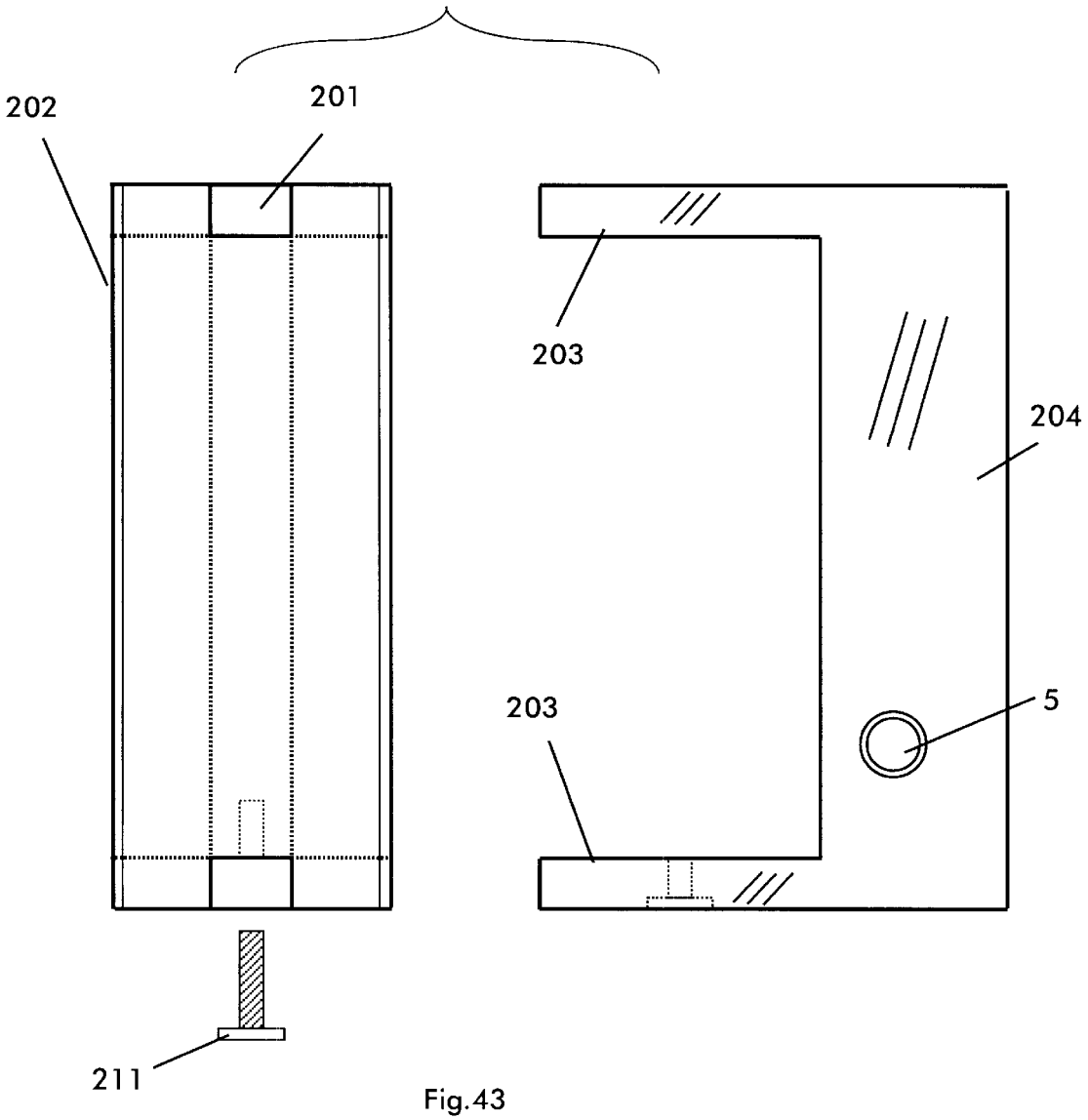
FIG. 43 is a disassembled top view of the putter shown in FIG. 37.
Figure 44:
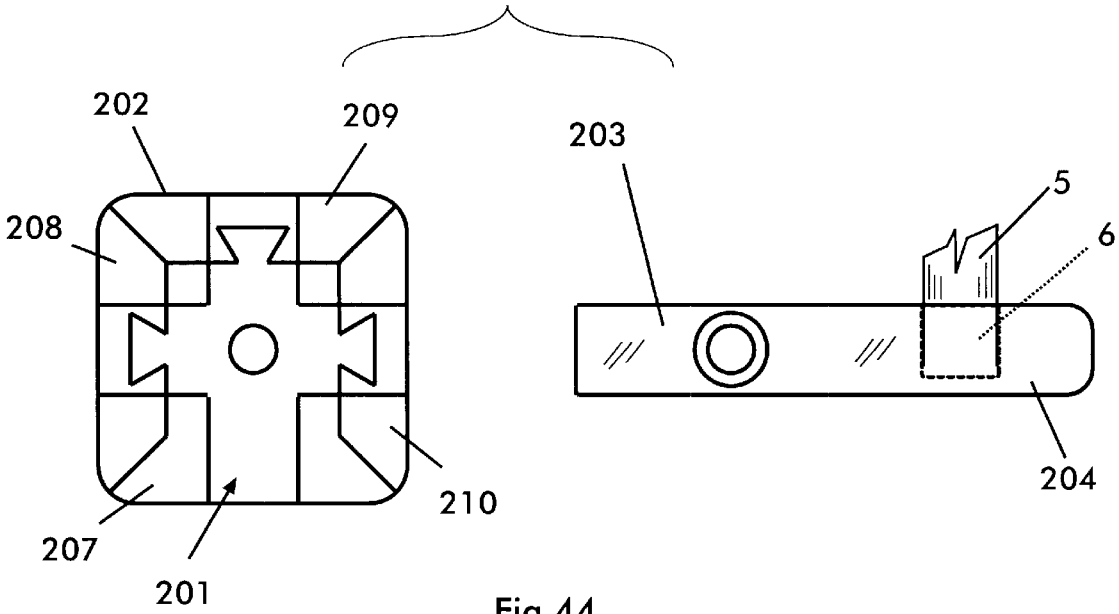
FIG. 44 is a disassembled side view of the putter shown in FIG. 37.
Figure 45:
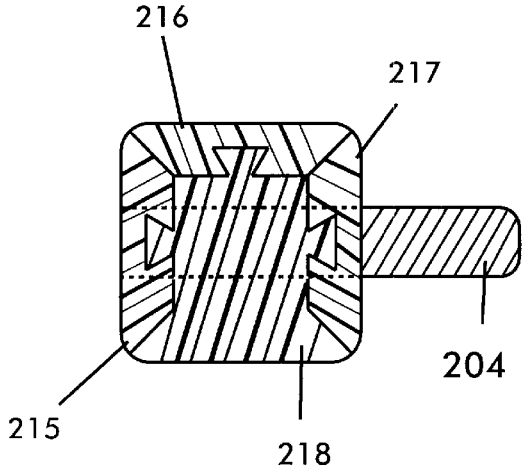
FIG. 45 is a section taken along lines III—III in FIG. 38.
Figure 46:
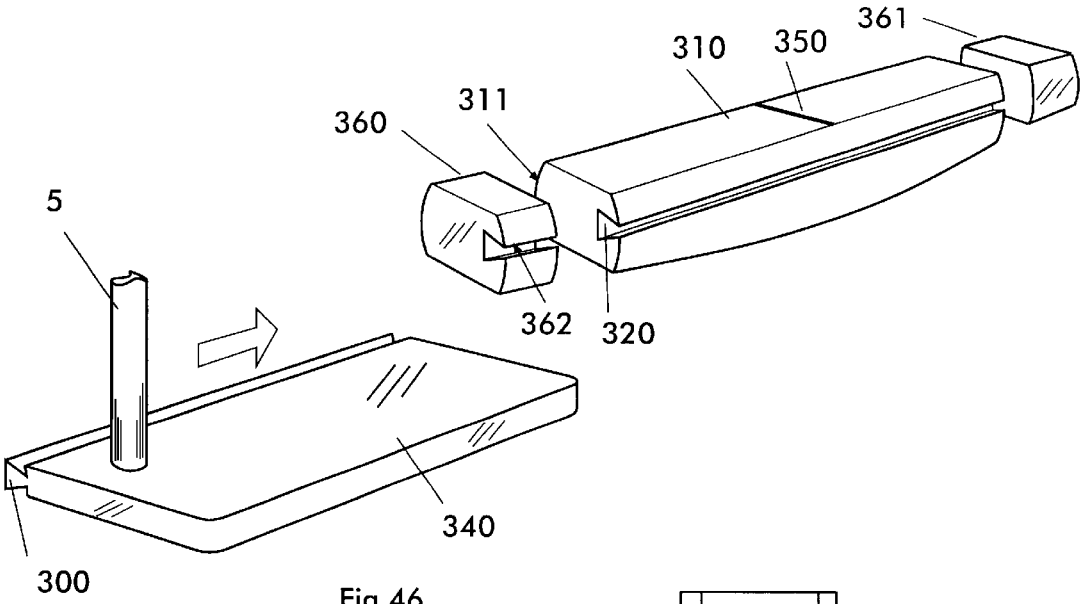
FIG. 46 is a disassembled perspective view of a sixth embodiment of a putter in accordance with the present invention.
Figure 47:
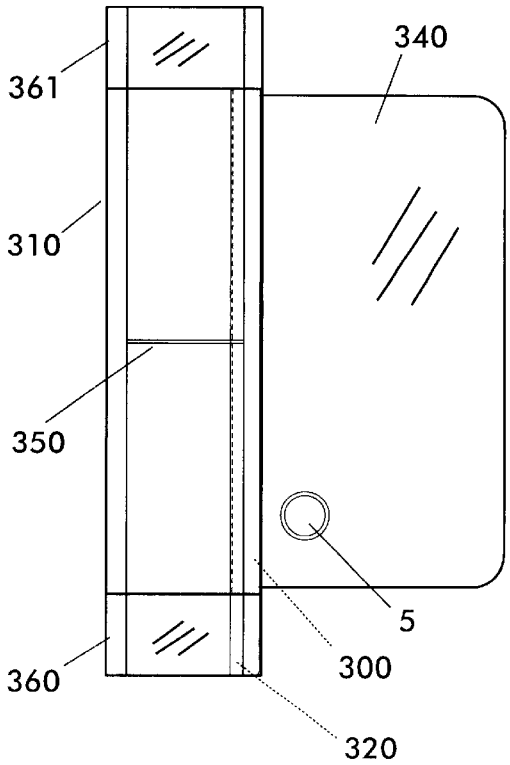
FIG. 47 is an assembled top view of the putter shown in FIG. 46.
Figure 48:
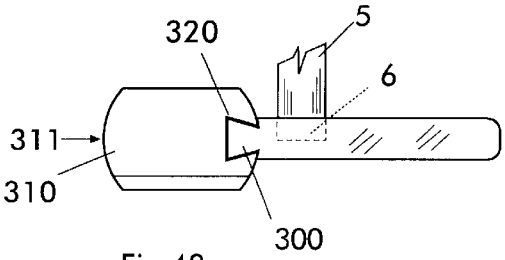
FIG. 48 is an assembled side view of the putter shown in FIG. 46.

FIG. 35 explains the design concept of the composite cylinder used to form the striking member 181. By the use of dovetail joints and adhesives, and a distinct machined profile, different materials, such as aluminum, copper, brass or elastomeric material such as Delrin™, have been fused and machined into a very unique part having four striking faces or surfaces 184, 185, 186 or 187 of four different materials. Again, this allows the golfer the ability to quickly and easily change the characteristics of the striking member without changing the remaining elements of the putter.

FIGS. 37–45 show a fifth embodiment of a putter in accordance with the present invention. This embodiment is similar to the fourth embodiment in which a single striking member, made with different materials, can be removed, re-oriented and reassembled into the putter to provide a striking surface of a different material for striking the ball. This putter has a fixed body 204 which is generally flat and has a rectangular configuration. The fixed body 204 includes a pair of attachment arms 203 extending outwardly from a leading edge of the fixed body 204 at opposite ends thereof and integral therewith. The arms 203 are elongated rectangular members which are spaced apart from each other and have the same general thickness as the remainder of the fixed body.

A striking member 202 in this embodiment is similar to the striking member in the fourth embodiment, except that it has a rectangular cross section and presents relatively flat striking surfaces for striking a ball. Slots or guideways 201 machined into the ends of the striking member 202 mate with the arms 203 of the fixed body 204 and hold the striking member 202 within the recess of the fixed body 204 defined by the arms 203. The striking surfaces of four different materials in the striking member 202 are shown by reference numerals 215, 216, 217 and 218.

The fixed body 204 may be manufactured from any suitable material per the first embodiment. Like the fourth embodiment, the design of the fixed body is such to maximize heel and toe weighting of the putter by the recessed area between guideways 201.

The assembly, disassembly and rotation of the composite rectangle striking member 202 in relation to the fixed body 204 are the same as the fourth embodiment. It should be pointed out that unlike the fourth embodiment, there is preferably a threaded pin 211 that inserts through one arm 203 and into the striking member 202 in order to lock the striking member 202 together with the fixed body 204 when assembled.

FIGS. 46–54 show a sixth embodiment of a putter in accordance with the present invention. This putter has a fixed body 340 and a dovetail guide 300 similar to that shown in FIGS. 1–19. A shaft 5 is attached to the fixed body 340 as discussed above. This putter has a striking member 310 which is similar to that shown in FIGS. 1–19 and has a striking surface 311. The striking member 310 is attached to and removed from the dovetail guide 300 in the fixed body 340 by means of a slot 320 machined into the striking member 310. A perpendicular guide slot 350 is machined into the top, flat surface of the striking member to act as an alignment guide during the putting stroke. In accordance with this sixth embodiment, heel weights 360 and toe weights 361 are added to the ends of the striking member 310. These weights 360, 361 extend outwardly beyond the fixed body 340 when the elements of the putter are assembled together and are preferably formed of metal, such as tungsten or copper. The placement and density of the weights 360, 361 help to stabilize the putter head on impact from off-center ball strikes and provide less twisting of the shaft which results in straighter putts.

Dovetail guide 300 machined into the fixed body 340 interlocks with dovetail slot 320 machined into interchangeable striking member 310. The dovetail slot 320 extends the length of the striking member 310 to the point where toe weight 361 and striking member 310 meet and includes a slot 362 forming an entry port at heel weight 360. No slot is included in toe weight 361, which acts as a stop similar to stop 4 in the first embodiment shown in FIGS. 1–10. The machine tolerances between guide 300 and slot 320 shall be such that an extremely tight friction fit shall be the result. This permits the combined striking member 310 and the heel and toe weights 360 and 361 of a specific material such as brass, aluminum or elastomeric material such as Delrin™ to be selected from a set by the golfer and quickly and easily changed.

Figure 49:
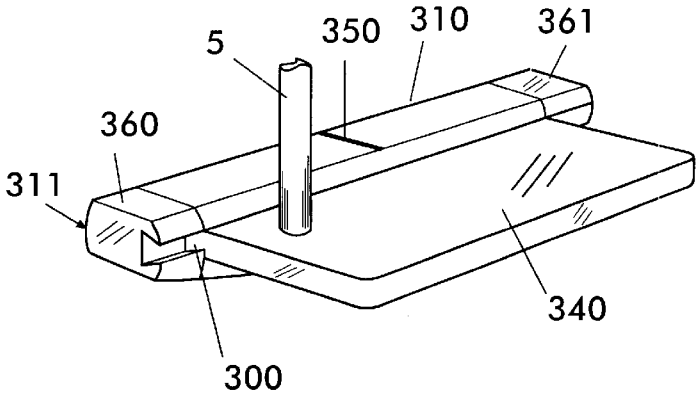
FIG. 49 is an assembled perspective view of the putter shown in FIG. 46.
Figure 50:
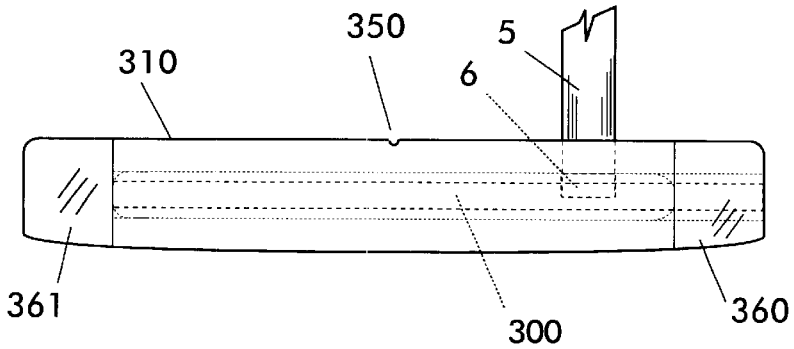
FIG. 50 is an assembled front view of the putter shown in FIG. 46.
Figure 51:
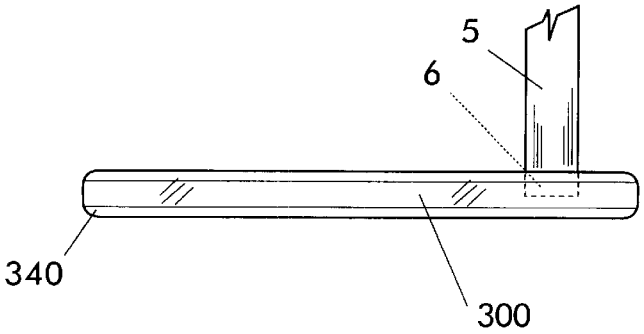
FIG. 51 is a disassembled front view of the putter shown in FIG. 46.
Figure 52:
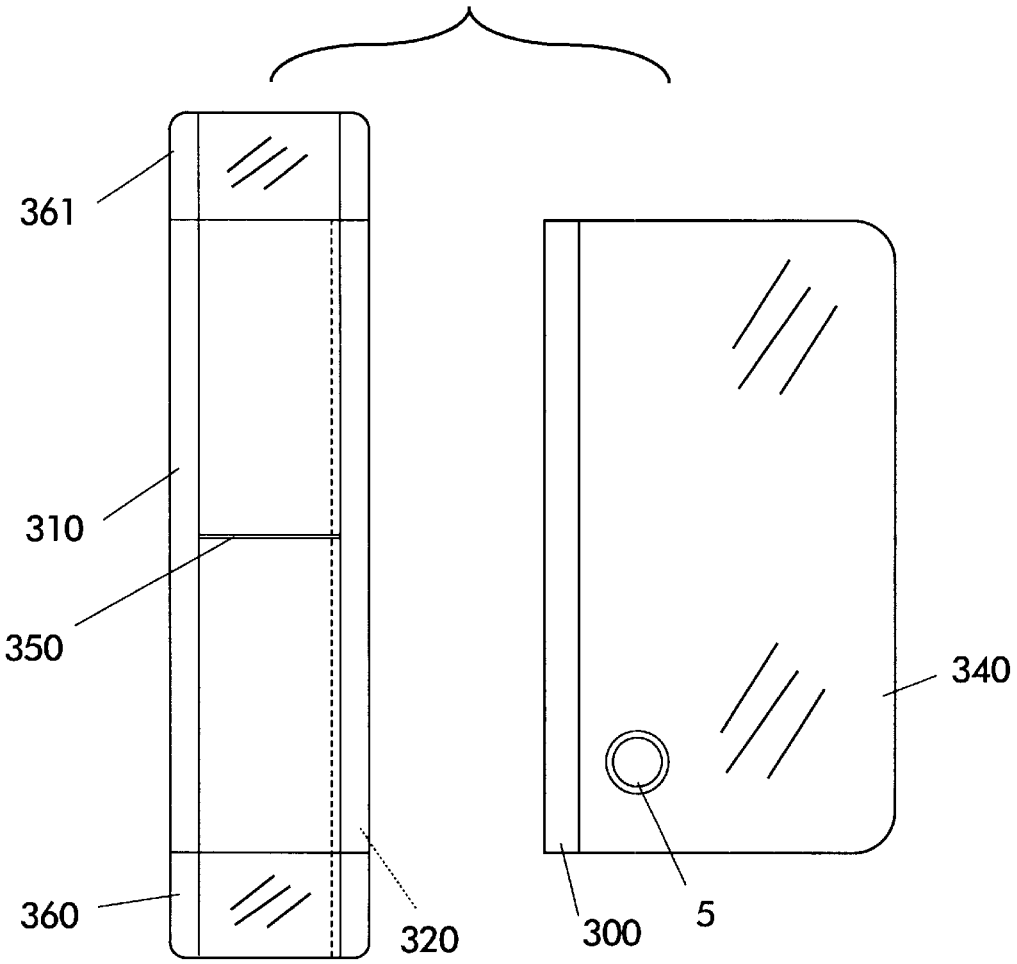
FIG. 52 is a disassembled top view of the putter shown in FIG. 46.
Figure 53:
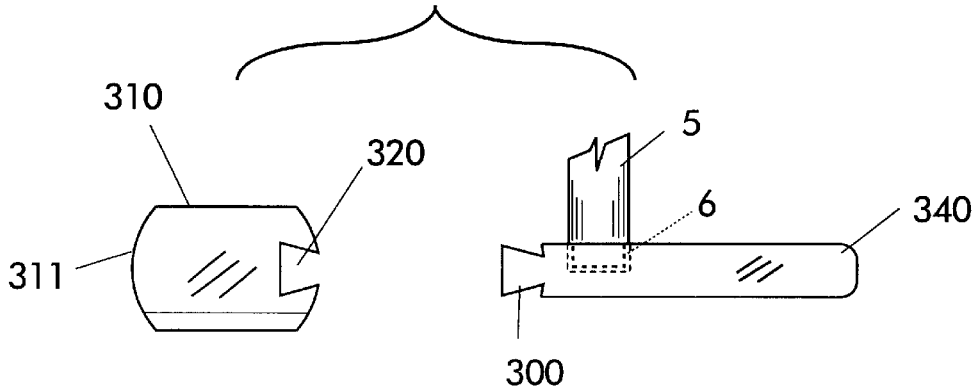
FIG. 53 is a disassembled side view of the putter shown in FIG. 46.
Figure 54:
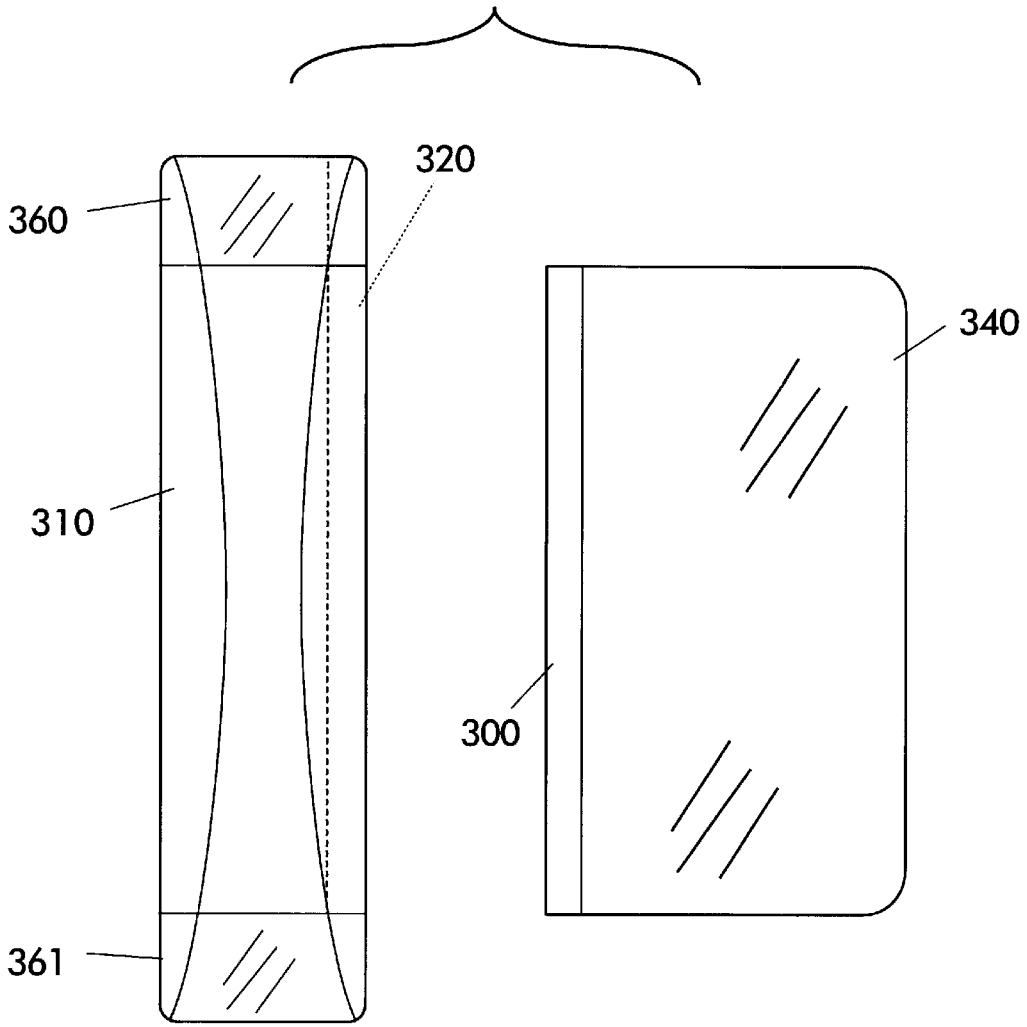
FIG. 54 is a disassembled bottom view of the putter shown in FIG. 46.
Figure 55:
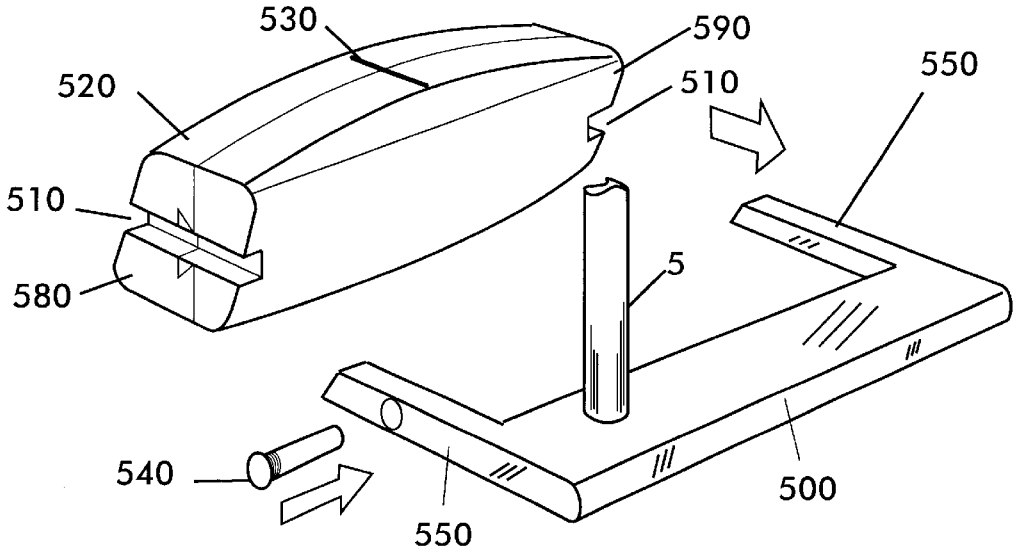
FIG. 55 is a disassembled perspective view of a seventh embodiment of a putter in accordance with the present invention.
Figure 56:
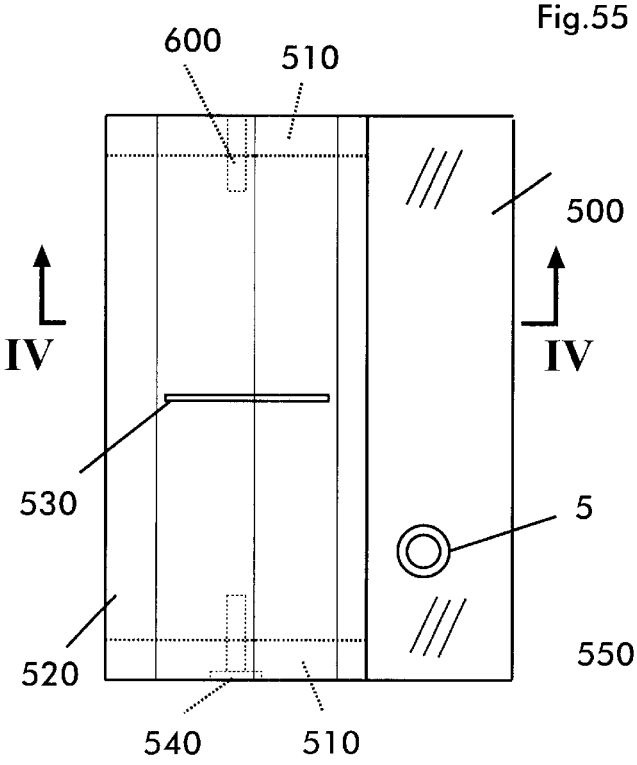
FIG. 56 is an assembled top view of the putter shown in FIG. 55.
Figure 57:
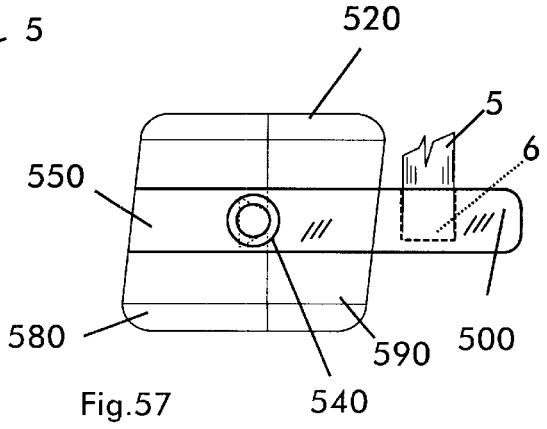
FIG. 57 is an assembled side view of the putter shown in FIG. 55.

To assemble the striking member 310 to the fixed body 340 as illustrated in FIG. 49, the golfer grasps the fixed body 340 in one hand and the striking member 310 in the other hand and positions dovetail guide 300 into the dovetail slot 362 at the entry port in the heel weight 360 and slides the elements together until both fixed body 340 and striking member 310 are seated. Accordingly, to remove striking member 310 from fixed body 340, simply reverse the procedure.

A seventh embodiment of a putter in accordance with the present invention is shown in FIGS. 55–63. This putter includes a fixed body 500 similar to that shown in FIGS. 37–45 and having a pair of attachment arms 550. A shaft 5 is attached to the fixed body 500. A striking member 520, having a single slot or guideway 510 at each end, is attached to the fixed body 500 by positioning the arms 550 into an associated slot 510 and by positioning the striking member into the recess between and engaging the arms 550.

The assembly and disassembly of the striking member 520 in relation to the fixed body 500 are similar when compared to the fifth embodiment except for the following. When changing from striking member 590 to striking member 580, the striking member 520 must first be rotated 180 degrees around the horizontal axis before sliding it onto arms 550. The striking member 520 then seats against a fixed stop 570. There is a threaded pin 540 that inserts through the one arm 550 and locks the striking member 520 together with the fixed body 500 when assembled as per the fifth embodiment.

Figure 58:
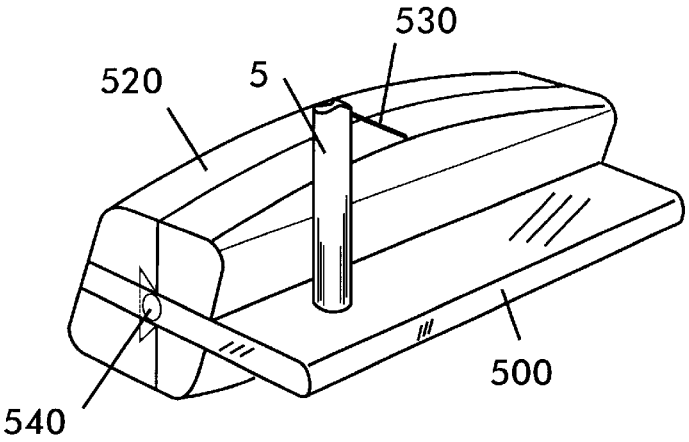
FIG. 58 is an assembled perspective view of the putter shown in FIG. 55.
Figure 59:
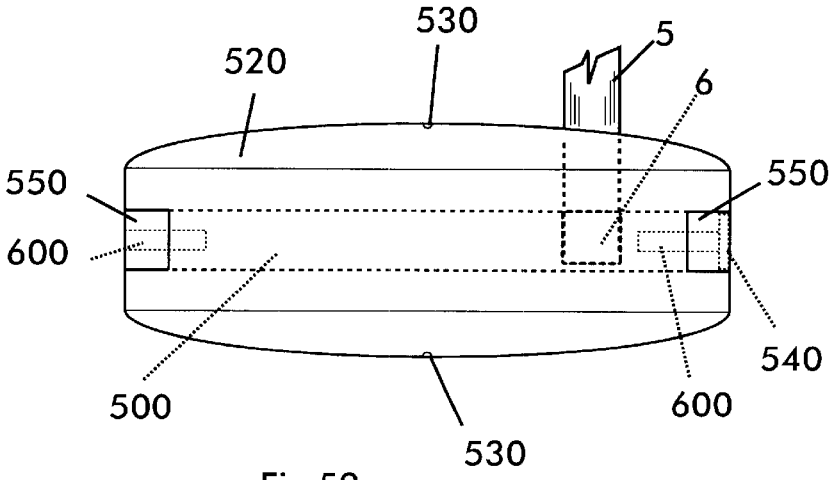
FIG. 59 is an assembled front view of the putter shown in FIG. 55.
Figure 60:
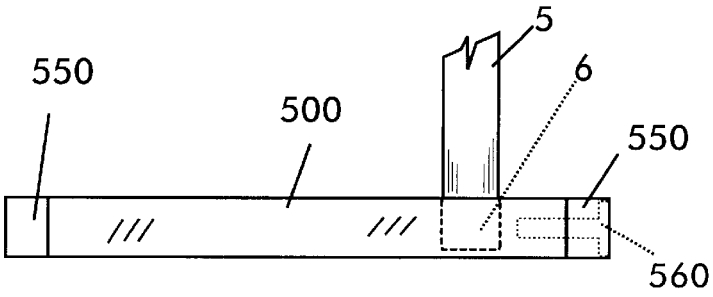
FIG. 60 is a disassembled front view of the putter shown in FIG. 55.
Figure 61:
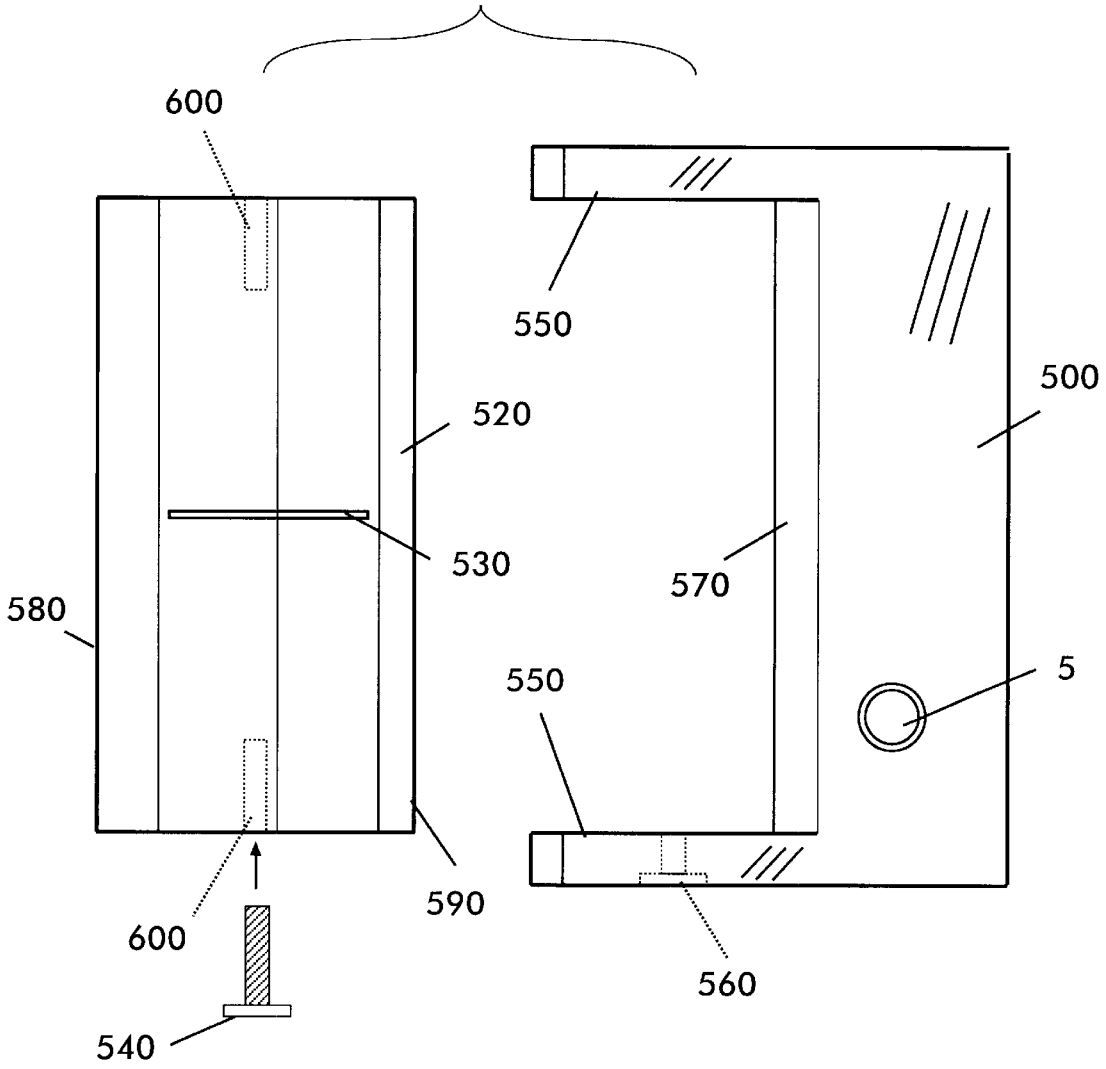
FIG. 61 is a disassembled top view of the putter shown in FIG. 55.
Figure 62:
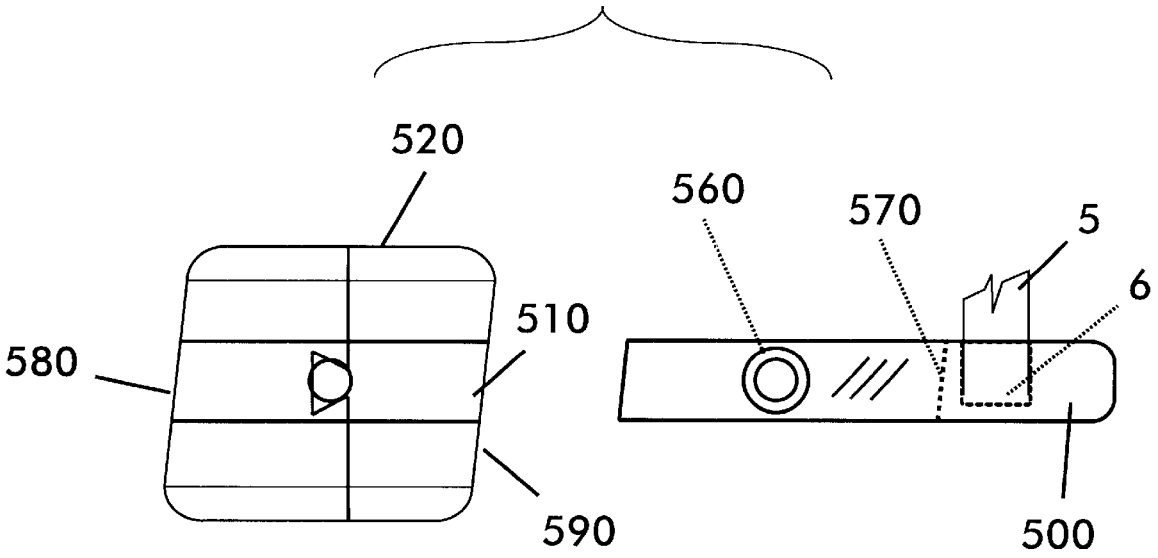
FIG. 62 is a disassembled side view of the putter shown in FIG. 55.
Figure 63:
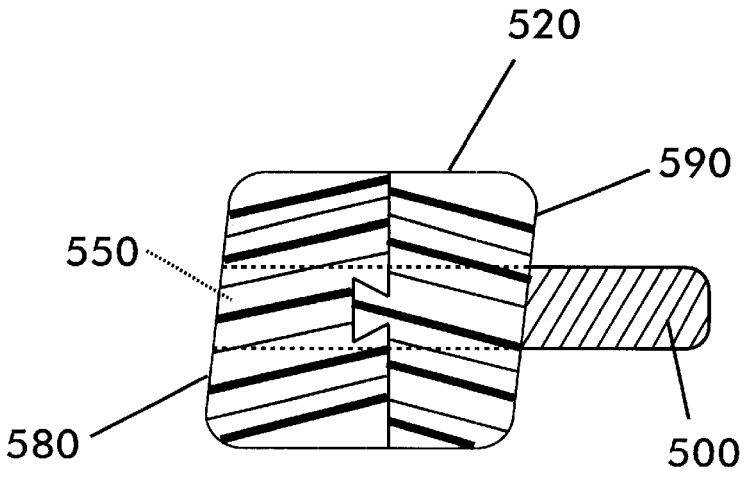
FIG. 63 is a section taken along line IV—IV in FIG. 56.

FIG. 62 explains the design concept of the striking member 520. It is essentially the same as the fifth embodiment except it is manufactured to take advantage of only two different materials, forming two different striking surfaces 580 and 590. One material is softer than the other. The added benefit of this design is a 5 degree angle on the face of the striking member 520. This should allow for more dwell time between the ball and putter with less ball skid as shown in FIGS. 58 and 59. The top and bottom of the striking surface have flat arches similar to the second embodiment. There are also visual alignment slots 530 machined into these surfaces as shown in FIG. 59.

The single striking member embodiments of the present invention, as shown in FIGS. 28–36, FIGS. 37–45 and FIGS. 55–63, have multiple separate and distinct striking surfaces which are each oriented in a direction different from the direction in which each of the other striking surfaces are oriented. As discussed above, the striking surfaces in the striking member are formed of a material different from the materials which form each of the other striking surfaces. As a result, the striking member can be removed from the fixed body, reoriented so that another of the striking surfaces is oriented outward, and reattached to the fixed body. In this way, the overall striking characteristics of the putter can be changed, due to the changed material of the striking surfaces, without changing the overall swing characteristics of the putter.

For all embodiments of a putter in accordance with the present invention the intent is to affect the rebound and resulting distance the golf ball travels from the putter face while the golfer maintains the exact same golf swing in relation to the conditions of the putting surface through the selected changing of the material forming the striking surface in an easy manner.

According to the provisions of the patent statutes, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. A putter comprising:

a) an elongated shaft;

b) a substantially flat fixed body attached to a lower end of the shaft and substantially perpendicular thereto;

c) a single striking member removably attached to a leading edge of the fixed body and having at least two separate and distinct striking surfaces, and with each striking surface of the striking member formed of a material different from the materials from which each of the other striking surfaces are formed and oriented in a direction different from the direction in which each of the other striking surfaces are oriented; and d) attachment means extending outward from and perpendicular to the leading edge of the fixed body and interacting with corresponding attachment means on the striking member so as to attach the striking member to the fixed body with one of its striking surfaces oriented outward, wherein the striking surface of the striking member which is directed outward and, hence, the striking characteristics of the overall putter, can be changed by removing the striking member from the fixed body, re-orienting the striking member so that another of the striking surfaces is oriented outward, and re-attaching the re-oriented striking member to the fixed body, all without changing the swing characteristics of the overall putter.

2. The putter of claim 1 wherein the attachment means on the fixed body are a pair of spaced apart arms and the attachment means on each striking member are corresponding slots on the ends thereof which interact with an associated arm on the fixed body.

3. The putter of claim 1 wherein each striking member is generally rectangular in shape and has flat striking surfaces.

4. The putter of claim 3 wherein the striking surfaces are each angled by about 3 degrees to 7 degrees from perpendicular.

5. The putter of claim 3 wherein the striking surfaces are each angled by about 5 degrees from perpendicular.

6. The putter of claim 1 wherein the shaft is a double-bent shaft.

* * * * *